US005124231A

United States Patent [19]

Sakai et al.

[11] Patent Number: 5,124,231

[45] Date of Patent: Jun. 23, 1992

[54] SILVER HALIDE PHOTOGRAPHIC MATERIAL

[75] Inventors: Minoru Sakai; Kazunobu Katoh, both of Kanagawa, Japan

[73] Assignee: Fuji Photo Film Co., Ltd., Kanagawa, Japan

[21] Appl. No.: 588,123

[22] Filed: Sep. 25, 1990

[30] Foreign Application Priority Data

Sep. 26, 1989 [JP] Japan ..... 1-250004

[51] Int. Cl.[5] ..... G03C 1/34; G03C 1/42

[52] U.S. Cl. ..... 430/264; 430/222; 430/223; 430/546; 430/598; 430/957

[58] Field of Search ..... 430/264, 598, 222, 223, 430/546, 957

[56] References Cited

U.S. PATENT DOCUMENTS 4,203,716 5/1980 Chen ..... 430/222
4,368,258 1/1983 Fujiwhara et al. ..... 430/222
4,619,884 10/1986 Singer et al. ..... 430/223
4,684,604 8/1987 Harder ..... 430/957
4,770,990 9/1988 Nakamura et al. ..... 430/959

*Primary Examiner*—Richard L. Schilling
*Attorney, Agent, or Firm*—Sughrue, Mion, Zinn Macpeak & Seas

[57] ABSTRACT

A silver halide photographic material which has at least one photosensitive silver halide emulsion layer containing a hydrazine derivative, and in which said emulsion layer and/or a hydrophilic colloid layer which is different from said emulsion layer contains a redox compound which release a development inhibitor when it is oxidized and an organic compound which is a melting-pointlowering agent which is essentially insoluble in water and which has the effect of lowering the melting point of said redox compound when the former has been mixed with the latter.

6 Claims, 1 Drawing Sheet

SILVER HALIDE PHOTOGRAPHIC MATERIAL

FIELD OF THE INVENTION

This invention relates a silver halide photographic material and to an ultra-high contrast negative image forming method using that material. In particular it relates to an ultra-high contrast negative photographic material which is appropriately used as a silver halide photographic material for use in a photographic platemaking process.

BACKGROUND OF THE INVENTION

In the field of photographic platemaking there is a need for photographic materials with good original reproducibility, stable processing solutions and an adequate simplification to cope with the complexity and the diversity of printing materials.

In particular, the original in a line photographic process is produced by plating photo-setting characters, handwritten characters, illustrations, halftone photographs and the like. Images with different densities and line widths are therefore intermixed in the original, and there is therefore a strong need for a platemaking camera, photographic materials and image-forming methods which foithfully reproduce such originals. Meanwhile, enlargement and reduction of the halftone photograph is widely undertaken in platemaking for catalogs and large posters, resulting in photographs with faded dots and coarsening in the line numbers in platemaking using enlargement of halftones. Reduction results in a photograph with a larger number of lines per inch and finer dots than the original. There is therefore a demand for an image-forming method with a much wider latitude in order to preserve the reproducibility of the halftone gradation.

Halogen lamps and xenon lamps are used as the light sources for platemaking cameras. The photographic material is usually orthochromatically sensitized in order to achieve the photographic speed for such light sources. However, orthochromatically sensitized photographic materials are more strongly affected by the differential color absorption of the lens, and it will be seen that the image quality is therefore likely to deteriorate. Furthermore, this deterioration is more pronounced with xenon lamp light sources.

One system which is intended to meet the demand for a wider latitude is a method in which a lithographic silver halide photosensitive material consisting of silver chlorobromide (with a silver chloride content of at least 50%) is processed in a hydroquinone developing solution with a highly reduced effective concentration of sulfite ions (normally 0.1 mole/l or less) to produce a line image or halftone image in which the image portion and the non-image portion are clearly separated and with a high contrast and high black density. However, at present, because of reduced sulfite concentration in the developing solution in this method, the developing solution is extremely unstable to atmospheric oxidation despite many attempts to keep the solution activity stable. Further, the processing speed is decidedly slow and the operating efficiency is low.

There is therefore a need for an image-forming system which overcomes the instability of image formation in a developing method (lithographic developing system) as has been described above, allows development in a processing solution with good storage stability and with which an ultra-high contrast photographic characteristic is obtained. There have been proposals for systems which form ultra-high contrast negative images with gammas of more than 10 which involve processing a surface latent image type silver halide photographic material to which a specific acylhydrazine compound has been added in a developing solution having a good storage stability and containing 0.15 mole/l or more of sulfite preservatives at a pH of 11.0 to 12.3, as can be seen from U.S Pat. Nos. 4,166,742, 4,168,977, 4,221,857, 4,224,401, 4,243,739, 4,272,606 and 4,311,781. Whereas only silver chlorobromides with a high silver chloride content could be used in conventional high-contrast image formation, this image-forming system has the distinguishing feature that silver iodobromide and silver chloroiodobromide can also be used.

The above image systems exhibit outstanding properties in their sharp halftone quality and their processing stability, rapidity and the reproducibility of the original, but there is a need for a system with even better original reproducibility in order to cope with the recent diversity of printing materials.

JP-A-61-213847 (the term "JP-A" as used herein means an "unexamined published Japanese Patent Application") and U.S. Pat. No. 4,684,604 disclose photographic materials which contain redox compounds which release photographically useful groups upon oxidation and disclose attempts at broadening the range of gradation reproduction. However, in ultra-high contrast processing systems employing hydrazine derivatives, these redox compounds have the disadvantage that they impair greater contrast and it has not been possible to take full advantage of their characteristics.

SUMMARY OF THE INVENTION

Accordingly, one object of this invention is to provide a photosensitive material for platemaking by which a high contrast image is obtained by using a highly stable developing solution.

A second object is to provide a photosensitive material for platemaking with a wide halftone gradation.

A third object is to provide a photosensitive material for platemaking with a wide halftone gradation with a high-contrast photosensitive material using a hydrazine nucleating agent.

A fourth object is to provide a photosensitive material for platemaking which permits high contrast has a wide halftone gradation and a stable photographic performance by including a redox compound which releases a development inhibitor when it is oxidized, in the coating solution in a stable manner such that it can adequately fulfill its intended use.

These and other objects of this invention are achieved by a silver halide photographic material which has (1) at least one type of photosensitive silver halide emulsion layer containing a hydrazine derivative, and (2) a hydrophilic colloid layer which is different from the photosensitive silver halide layer mentioned above and which contains a melting-point-lowering agent and a redox compound which releases a development inhibitor when it is oxidized.

Figure 1:
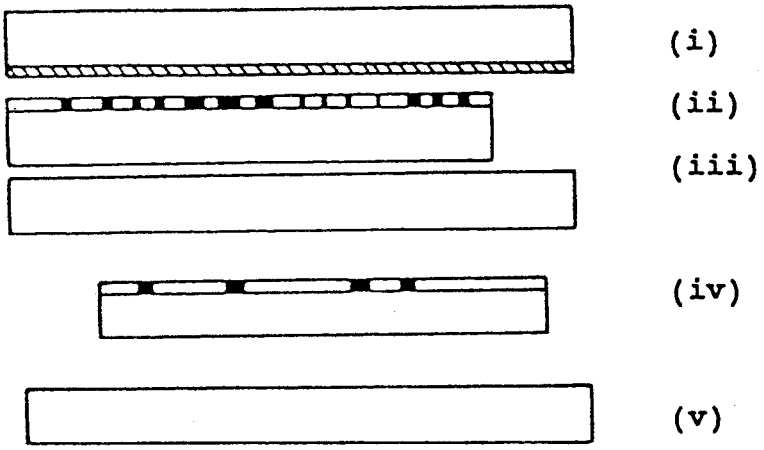
FIG. 1 shows the costitution during exposure on forming a transparent line image portions in dot images in contact work, the references denote the following.

(i) Transparent or semi-transparent adhesive base.

(ii) Line original (where the dark portions denote the lines).

(iii) Transparent or semi-transparent adhesive base.

(iv) Halftone original (where the dark portions denote the halftone).

(v) Photosensitive material for reversal (where the oblique lines show the photosensitive layer).

DETAILED DESCRIPTION OF THE INVENTION

The redox compound which releases a development inhibitor when it is oxidized is now discussed.

The redox compound of this invention has, as the redox group, a hydroquinone, catechol, naphthohydroquinone, aminophenol, pyrazolidone, hydrazine, hydroxylamine or a redactone.

The preferred redox compounds are those that have a hydrazine as the redox group.

More preferable among the above redox compounds are those represented by the following general formula (I): formula (I)

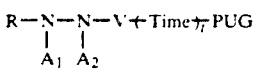

General formula (I)

In this formula, $A_1$ and $A_2$ are both hydrogen atoms or one is a hydrogen atom and the other a sulfinic acid residual group or

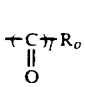

(in the formula, $R_0$ represents an alkyl group, alkenyl group, aryl group, alkoxy group or aryloxy group, and l represent 1 or 2.) Time represents a divalent linking group, and t represents 0 or 1. PUG represents a development inhibitor. V represents a carbonyl group,

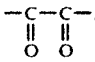

a sulfonyl group, a sulfoxy group,

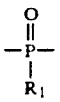

representing an alkoxy or aryloxy group), an iminomethylene group or a thiocarbonyl group. R represents an aliphatic group, aromatic group or heterocyclic group.

General formula (I) is now discussed in greater detail.

In general formula (I), $A_1$ and $A_2$ represent hydrogen atoms, C-20 or lower alkylsulfonyl groups and arylsulfonyl groups (preferably a phenylsulfonyl group or a phenylsulfonyl group which has been substituted such that the sum of the Hammett substituent constants is −0.5 or more),

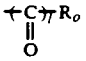

($R_0$ preferably being a C-30 or lower straight chain, branched or cyclic alkyl group, alkenyl group, aryl group (preferably a phenyl group or a phenyl group which has been substituted such that the sum of the Hammett substituent constants is −0.5 or more), alkoxy group (for example an ethoxy group), aryloxy group (preferably a monocyclic one) and the like. These groups may have substituent groups such as those substituent groups given below. These groups may be further substituted.

Examples of the substituents include an alkyl group, aralkyl group, alkenyl group, alkynyl group, alkoxy group, aryl group, substituted amino group, acylamino group, sulfonylamino group, ureido group, urethane group, aryloxy group, sulfamoyl group, carbamoyl group, alkylthio group, arylthio group, sulfonyl group, sulfinyl group, hydroxyl group, halogen atoms, cyano group, sulfo group and carboxyl group, aryloxycarbonyl group, acyl group, alkoxycarbonyl group, acyloxy group, carbonamido group, sulfonamido group, nitro group, alkylthio group, arylthio group and the like. The sulfinic acid residual group represented by $A_1$ or $A_2$ specifically denotes the group described in U.S. Pat. No. 4,478,928.

Furthermore, $A_1$ may link with the previously mentioned —Time)$_t$ form a ring.

A hydrogen atom is most preferred as $A_1$ and $A_2$.

Time represents a divalent linking group and may have a timing regulating function. t represents 0 or 1, and signifies that PUG is directly linked to V when t=0.

The divalent linking group represented by Time denotes a group which, via a reaction in one or several stages, releases PUG from Time-PUG which is released from the oxidized form of the redox parent nucleus.

The divalent linking groups represented by Time include those which release a photographically useful group (PUG) by a ring-closing reaction within the molecule of a p-nitrophenoxy derivative as described, for example, in U.S. Pat. No. 4,248,962 (JP-A-54-145135); those which release a PUG by a ring-closing reaction within the molecule after a ring-opening as described, for example, in U.S. Pat. No. 4,310,612 (JP-A-55-53330) and U.S. Pat. No. 4,358,252; those which release a PUG along with the production of an acid anhydride by a ring-closing reaction within the molecule of the carboxyl group of succinic acid monoester or an analog thereof as described, for example, in U.S. Pat. Nos. 4,330,617, 4,446,216, 4,483,919 and JP-A-59-121328; those which release a PUG by producing quinomonomethane or a derivative thereof by electron transfer via a divalent bond in which an aryloxy group or heterocyclic oxy group is conjugated as described, for example, in U.S. Pat. Nos. 4,409,323, 4,421,485, Research Disclosure No. 21,228 (December 1981), U.S. Pat. No. 4,416,977 (JP-A-57-135944), JP-A-58-209736 and JP-A-58-209738; those which release a PUG from the γ-position of an enamine by electron transfer at the moiety having the enamine structure in a nitrogen-containing hetero ring as described, for example, in U.S. Pat. No. 4,420,554 (JP-A-5-136640), JP-A-57-135945, JP-A-57-188035, JP-A-58-98728 and JP-A-58-209737; those which release a PUG by a sequestering reaction within the molecule of an oxy group produced by electron transfer to a carbonyl group which has been conjugated with the nitrogen group in a nitrogen-containing hetero ring as described in JP-A-57-56837; those which release a PUG along with the production of an aldehyde as described, for example, in U.S. Pat. No. 4,146,396 (JP- A-52-90932), JP-A-59-93442 and JP-A-59-75475; those which release a PUG along with removal of carbon from the carboxyl group as described in JP-A-51-146828, JP-A-57-179842 and JP-A-59-104641; those which have the structure -0-$COOCR_2R_b$-PUG and which release PUG along with the production of an aldehyde following removal of carbon; those which release a PUG along with the production of an isocyanate as described in JP-A-60-7429; and those which release a PUG by a coupling reaction with the oxidized form of a color-developing agent as described, for example, in U.S. Pat. No. 4,438,193.

Actual examples of the divalent linking groups represented by Time are described in detail in, inter alia, JP-A-61-236549 and JP-A-1-261936, the preferred actual examples being those given below.

Here (*) represents the position at which —Time)$_t$ PUG is linked to V in general formula (I), and the position at which Time is linked to PUG is represented at (*) (*).

T-(1)

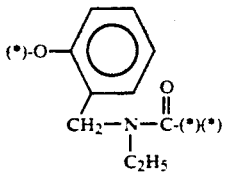

T-(2)

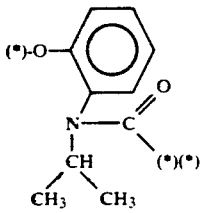

T-(3)

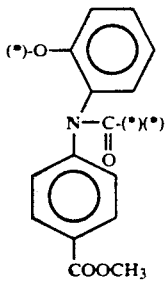

T-(4)

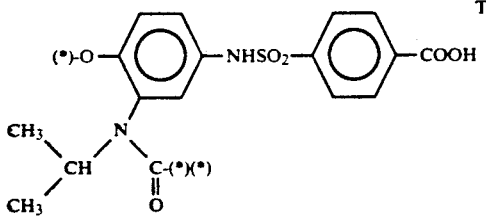

T-(5)

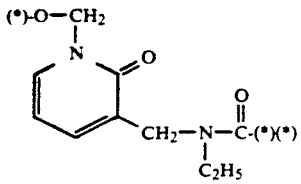

-continued

T-(6)

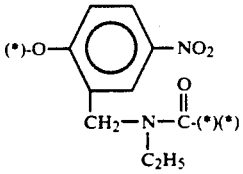

T-(7)

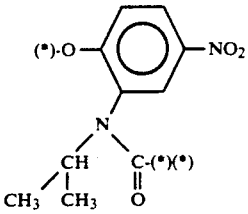

T-(8)

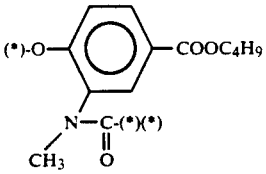

T-(9)

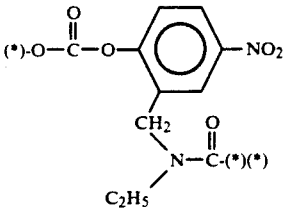

T-(10)

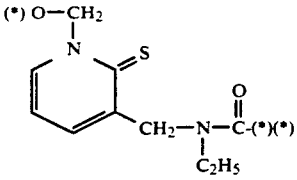

T-(11)

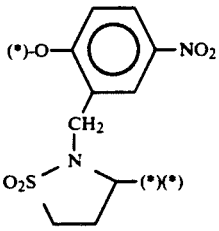

T-(12)

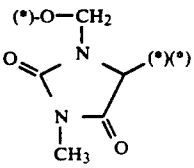

-continued
T-(13)
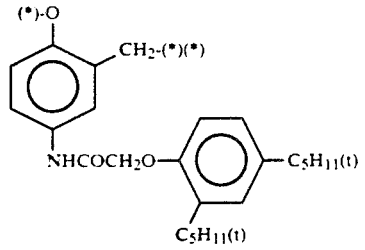
T-(14)
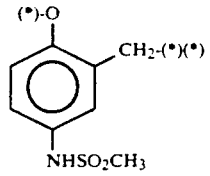
T-(15)
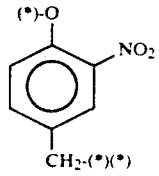
T-(16)
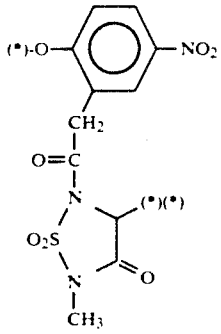
T-(17)
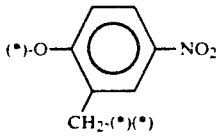
T-(18)
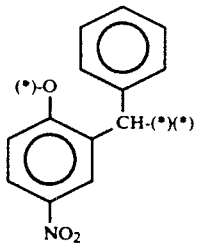
T-(19)
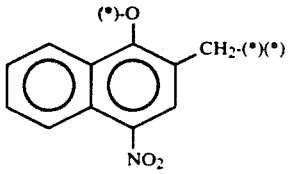
-continued
T-(20)
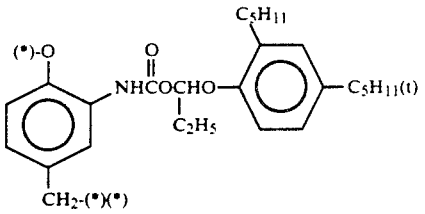
T-(21)
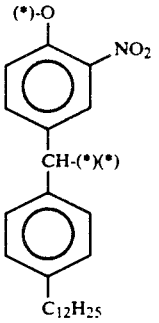
T-(22)
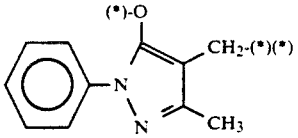
T-(23)
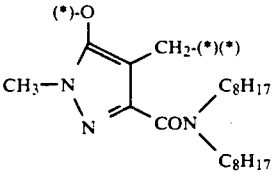
T-(24)
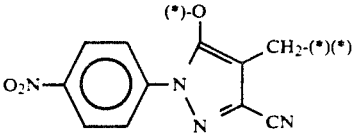
T-(25)
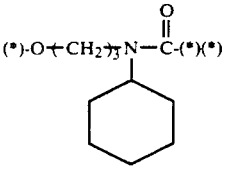
T-(26)
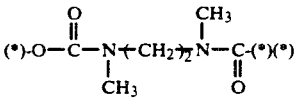
T-(27)
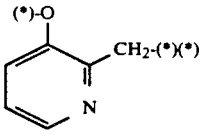
T-(28)
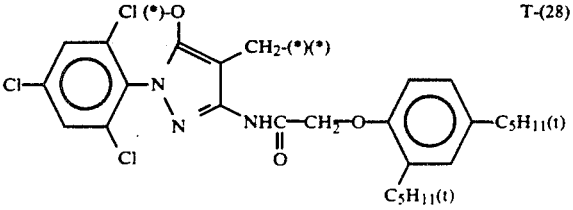

-continued

T-(29)

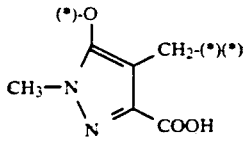

T-(30)

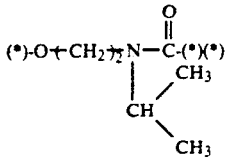

T-(31)

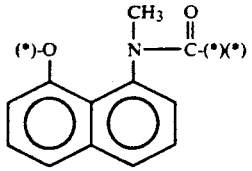

T-(32)

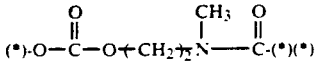

T-(33)

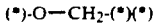

T-(34)

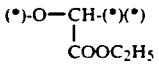

T-(35)

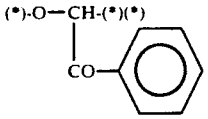

T-(36)

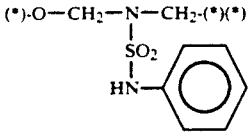

T-(37)

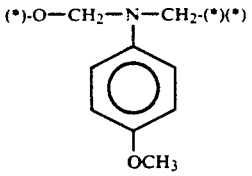

T-(38)

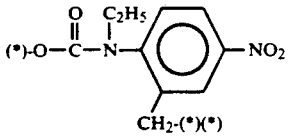

T-(39)

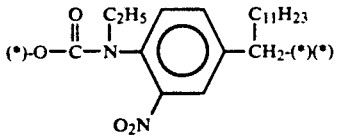

T-(40)

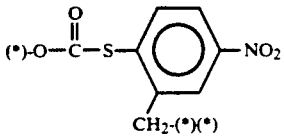

T-(41)

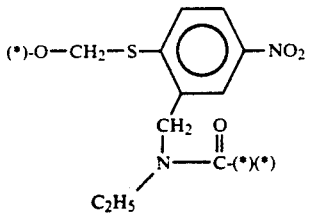

T-(41)

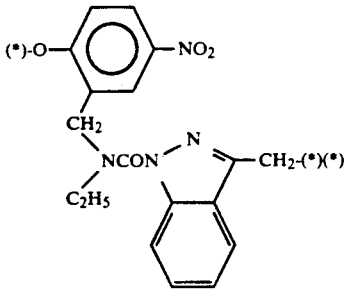

PUG represents a group having a development-inhibiting effect as PUG or $(Time)_t$ PUG, that is upon oxidation of the redox compound.

The development inhibitor represented by PUG or $(Time)_t$ PUG is a known development inhibitor having a heteroatom and linked via the heteroatom to Time. They are described, for example, on pages 344–346 of "The Theory of the Photographic Process" by C. E. K. Mees and T. H. James, Vol. 3, (Macmillan, 1966). Examples include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, mercaptoaryls and the like.

The development inhibitor represented by PUG may be substituted. Substituents include the following groups and these groups may be further substituted: an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkythio group, an arylthio group, a sulfonyl group, a sulfinyl group, a hydroxyl group, a halogen atoms, a cyano group, a sulfo group, an alkyloxycarbonyl group, an aryloxycarbonyl group, an acyl group, an alkoxycarbonyl group, an acyloxy group, a carboxyamido group, a sulfonamido group, a carboxyl group, a sulfoxy group, a phosphono group, a phosphinico group and a phosphoramido group and the like.

Preferred substituents include the nitro, sulfo, carboxyl, sulfamoyl, phosphono, phosphinico and sulfonamido groups.

The principal development inhibitors are given below.

1. Mercaptotetrazole Derivatives
   (1) 1-Phenyl-5-mercaptotetrazole
   (2) 1-(4-Hydroxyphenyl)-5-mercaptotetrazole
   (3) 1-(4-Aminophenyl)-5-mercaptotetrazole
   (4) 1-(4-Carboxyphenyl)-5-mercaptotetrazole
   (5) 1-(4-Chlorophenyl)-5-mercaptotetrazole
   (6) 1-(4-Methylphenyl)-5-mercaptotetrazole (7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Dichlorohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazolyl)ethyltrimethylammonium chloride
(34) 1-(3-Phenoxycarbonylphenyl)-5-mercaptotetrazole
(35) 1-(3-Maleinimidophenyl)-6-mercaptotetrazole 2. Mercaptotriazole Derivatives
(1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Derivatives
(1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine Derivatives
(1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives
(1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Derivatives
(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzothiazole Derivatives
(1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole 8. Mercaptobenzoxazole Derivatives
(1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole 9. Benzotriazole Derivatives
(1) 5,6-Dimethylbenzotrrazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole, sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10 Benzimidazole Derivatives
(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Derivatives
(1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole 12. Tetrazole Derivatives
(1) 5-(4-Nitrophenyl)tetrazole
(2) 5-Phenyltetrazole
(3) 5-(3-Carboxyphenyl)tetrazole 13. Tetraazaindene Derivatives (1) 4-Hydroxy-6-methyl-5-nitro-1,3,3a,7-tetraazaindene (2) 4-Mercapto-6-methyl-5-nitro-1,3,3a,7-tetraazaindene 14. Mercaptoaryl Derivatives (1) 4-Nitrothiophenol (2) Thiophenol (3) 2-Carboxythiophenol.

V in formula (I) represents a carbonyl group,

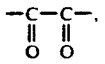

a sulfonyl group, a sulfoxy group,

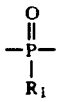

(where R represents an alkoxy or an aryloxy group), an iminomethylene group or a thiocarbonyl group, and V is preferably a carbonyl group.

The aliphatic group represented by R is a straight-chain, branched or cyclic alkyl group, alkenyl group, or alkynyl group and is preferably one with 1-30 carbon atoms, particularly preferably one with 1-20 carbon atoms. The branched alkyl group may be cyclized to form a saturated hetero ring system containing one or more heteroatoms within it.

Examples of the aliphatic R groups include a methyl group, a t-butyl group, an n-octyl group, a t-octyl group, a cyclohexyl group, a hexenyl group, a pyrrolidyl group, a tetrahydrofuryl group, an n-dodecyl group and the like.

The examples of aromatic R group is a monocyclic or bicyclic aryl group, examples including phenyl and naphthyl groups.

The examples of hetero ring system is a saturated or unsaturated 3- to 10-member hetero ring system containing at least one N, O or S atom. They may be single rings or may form fused rings with other aromatic rings or hetero rings. Preferred hetero rings include 5- to 6-membered aromatic hetero rings, examples including a pyridine ring, an imidazolyl group, a quinolinyl group, a benzimidazolyl group, a pyrimidinyl group, a pyrazolyl group, an isoquinolinyl group, a benzothiazolyl group and a thiazolyl group.

R may be substituted by substituent groups. Examples of the substituent groups include those given below. These groups may be further substituted.

Examples of the R groups include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfothio group, a sufinyl group, a hydroxyl group, a halogen atoms, a cyano group, a sulfo group, an alkyloxycarbonyl group, an aryloxycarbonyl group, an acyl group, an alkoxycarbonyl group, an acyloxy group, a carboxamido group, a sulfonamido group, a carboxy group, a phosphoramido group and the like.

Further, in general formula (I), R or —Time)$_t$ PUG may include ballast groups which are commonly used in immovable photographic additives such as couplers, and groups which promote the adsorption of the compound represented by general formula (I) to silver halides.

A ballast group is an organic group which provides adequate molecular weight such that the compound represented by general formula (I) is essentially unable to diffuse into other layers or into the processing solutions. It consists of a combination of one or more of the following: alkyl groups, aryl groups, heterocyclic groups, ether groups, thioether groups, amido groups, ureido groups, urethane groups, sulfonamido groups and the like. A ballast group having a substituted benzene ring is preferred as the ballast group, a ballast group having a benzene ring substituted with a branched alkyl group being particularly preferred.

Groups promoting adsorption of the compound of general formula (I) to silver halides specifically include 4-thiazoline-2-thione, 4-imidiazoline-2-thione, 2-thiohydantoin, rhodanine, thiobarbiturates, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, 1,3-imidazoline-2-thione and other such cyclic thioamido groups, linear thioamido groups, aliphatic mercapto groups, aromatic mercapto groups, heterocyclic mercapto groups (when there is a nitrogen atom next to the carbon atom linked to the —SH group, this has the same signification as the tautomerically related cyclic thioamido group, specific examples of this group being the same as those given above), groups with a disulfide bond, benzotriazole, triazole, tetrazole, indazole, benzimidazole, imidazole, benzothiazole, thiazole, thiazoline, benzoxazole, oxazole, oxazoline, thiadiazole, oxathiazole, triazine, azaindene and other such 5-membered to 6-membered nitrogen-containing heterocyclic groups consisting of a combination of nitrogen, oxygen, sulfur and carbon, and quarternary salts of heterocylic rings such as benzimidazolium.

These may be further substituted by suitable substituent groups.

Such substituent groups include, for example, those given as substituent groups for R.

Specific examples of the redox compounds used in this invention are listed below, but the invention is not limited to these:

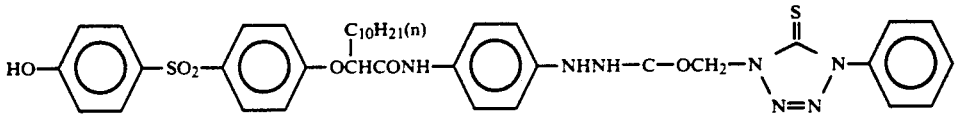

1.

-continued
2.
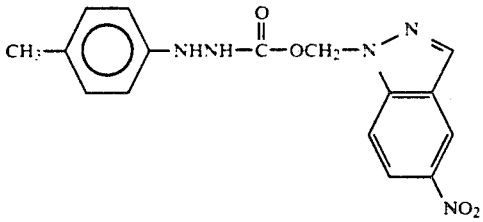
3.
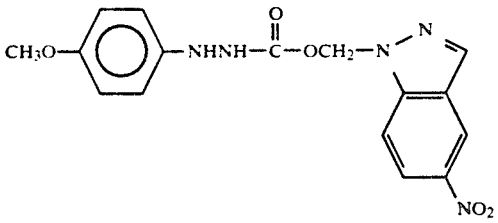
4.
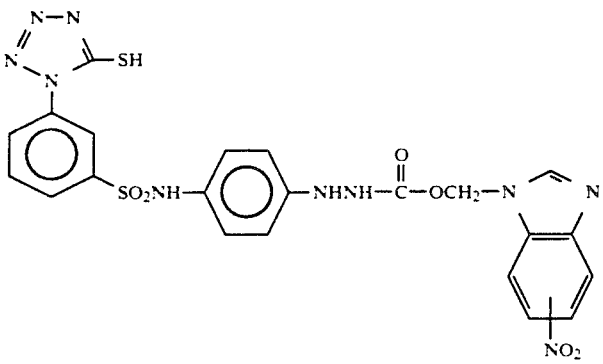
5.
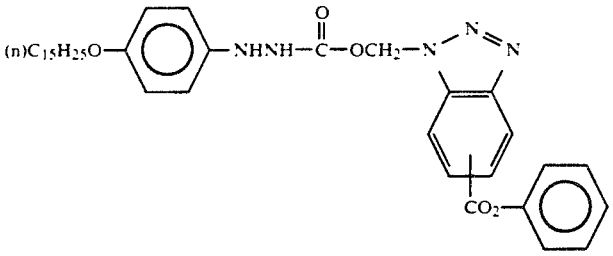
6.
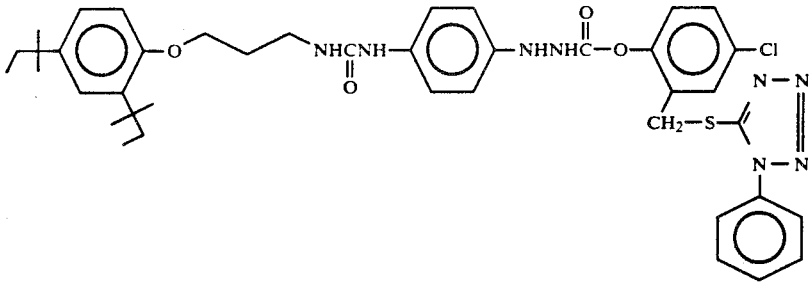
7.
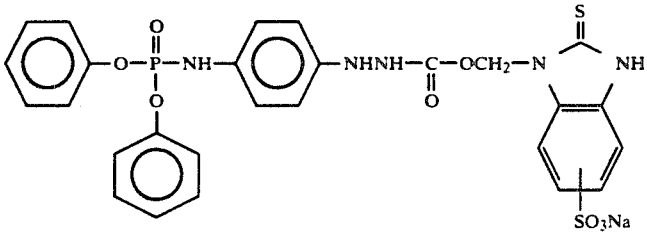

-continued
8.
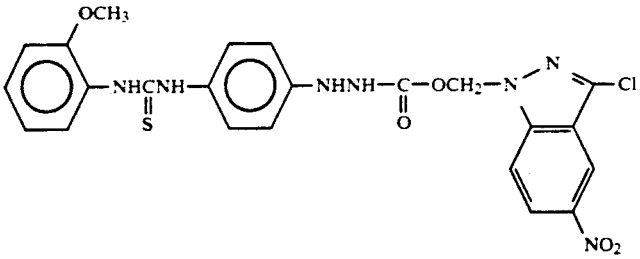
9.
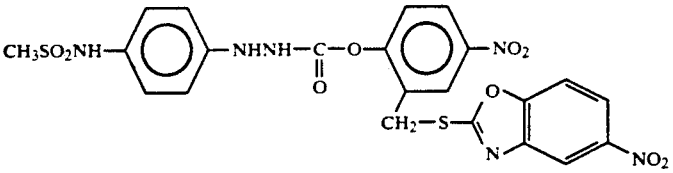
10.
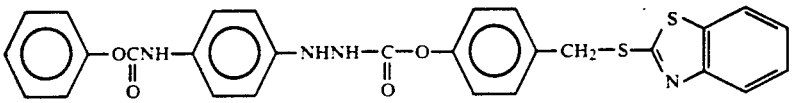
11.
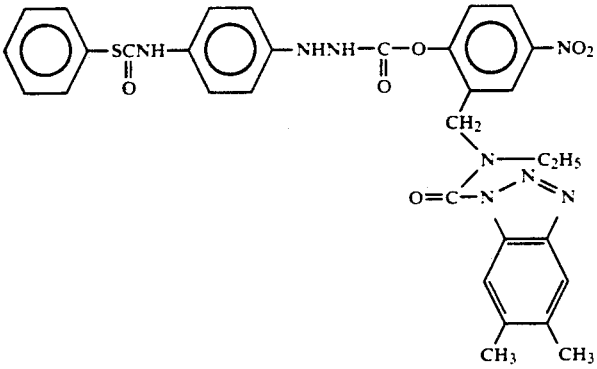
12.
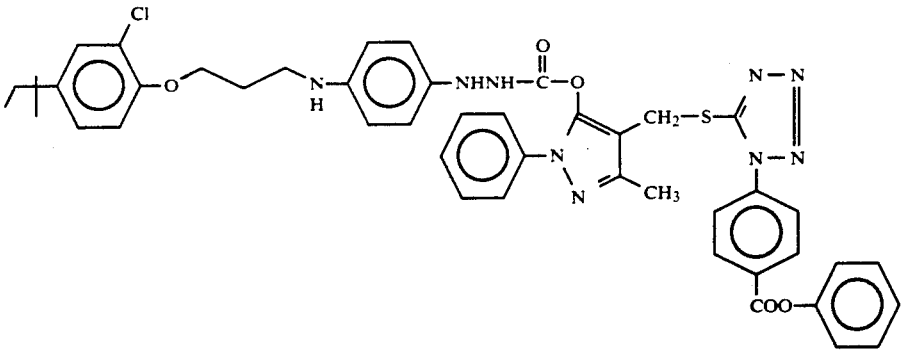
13.
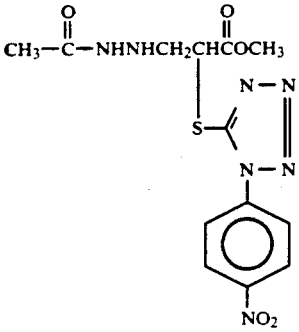

-continued
14.
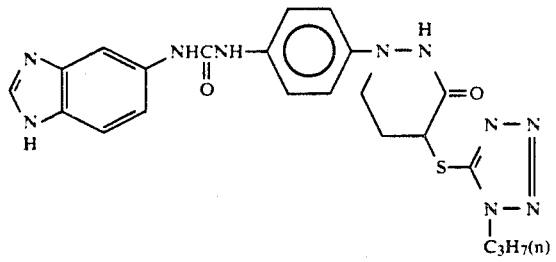
15.
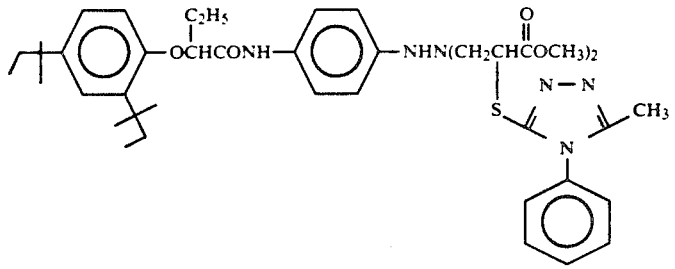
16.
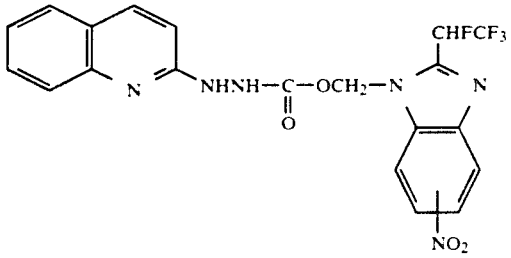
17.
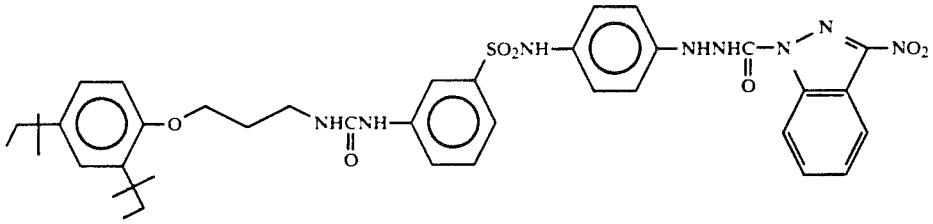
18.
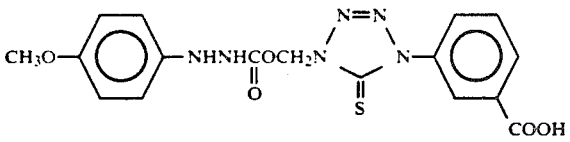
19.
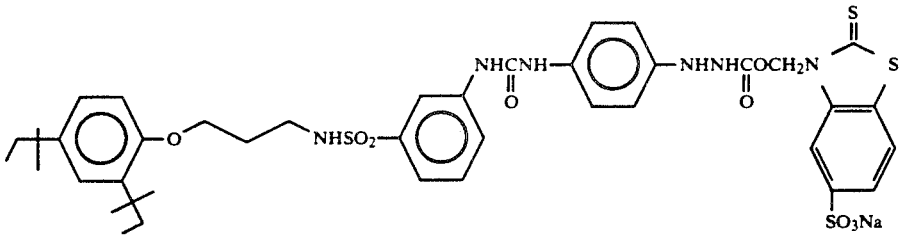
20.
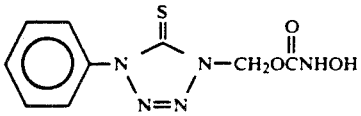

-continued
21.
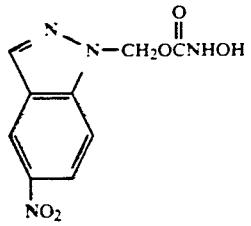
22.
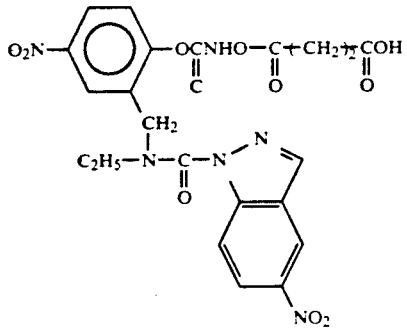
23.
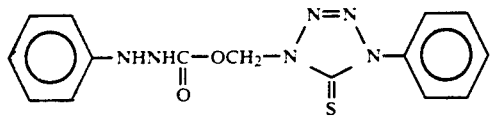
24.
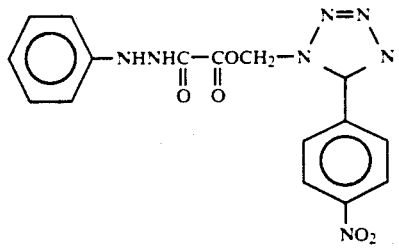
25.
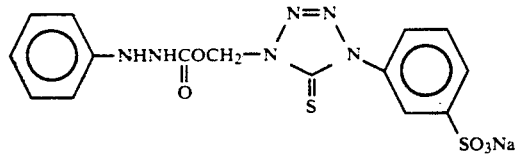
26.
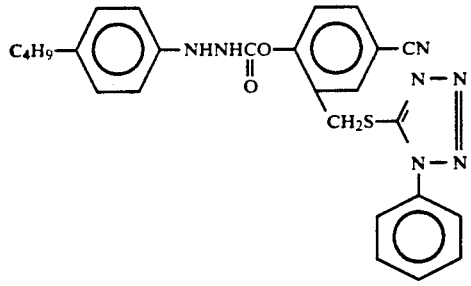
27.
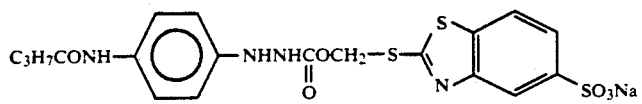

-continued
28.
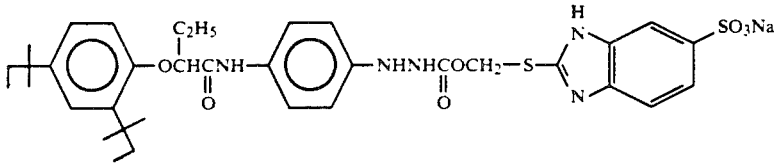
29.
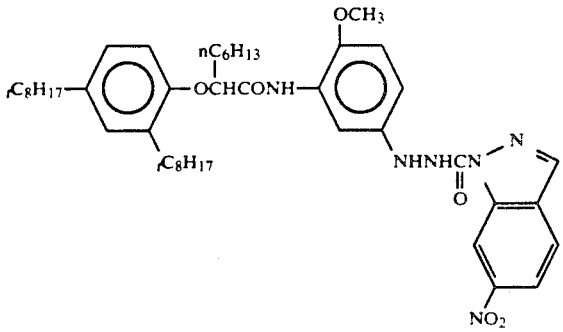
30.
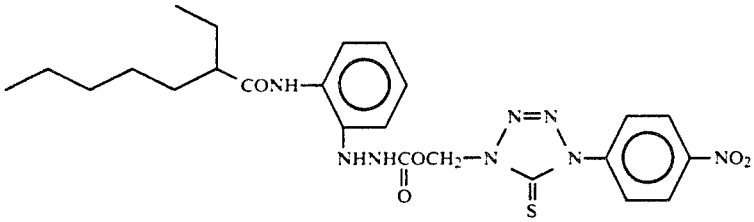
31.
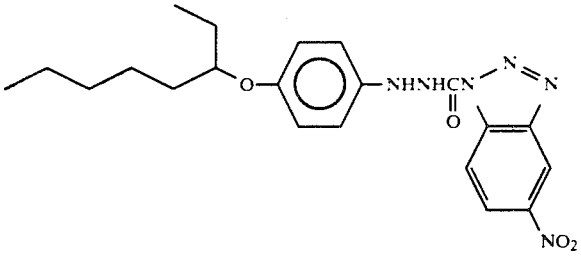
32.
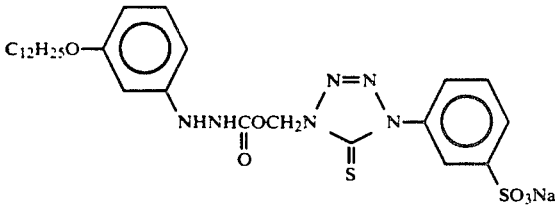
33.
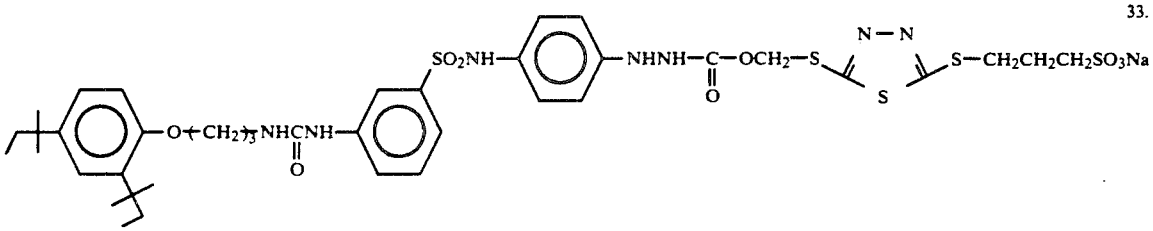

-continued
34.
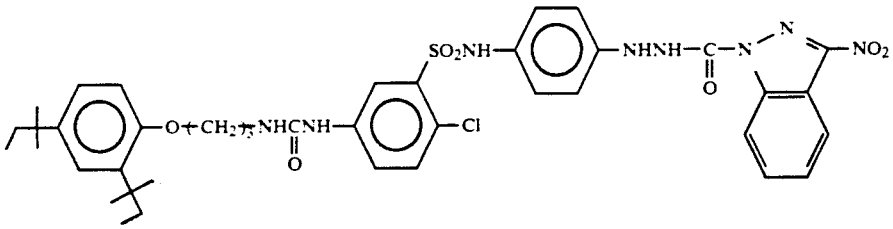
35.
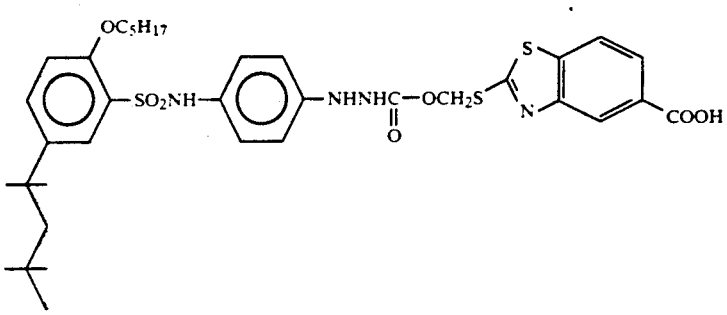
36.
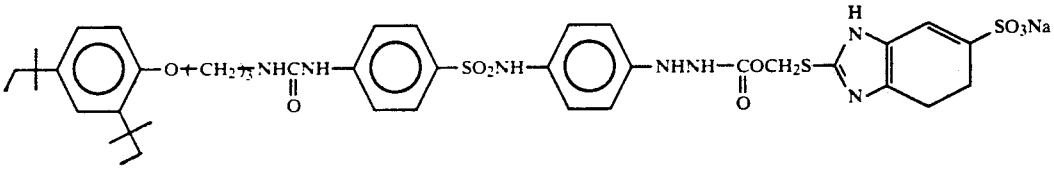
37.
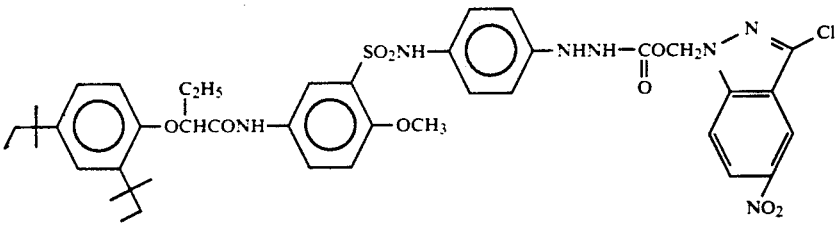
38.
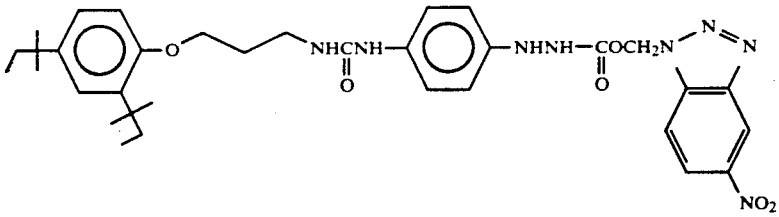
39.
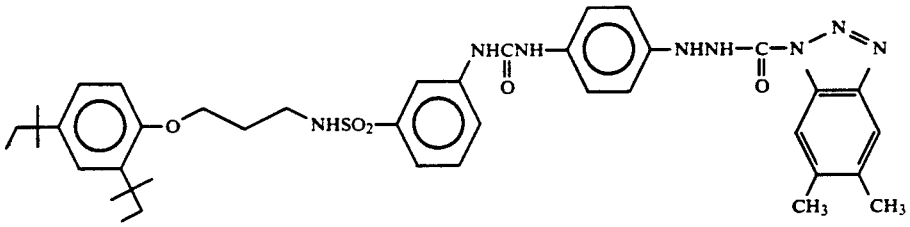

-continued
40.
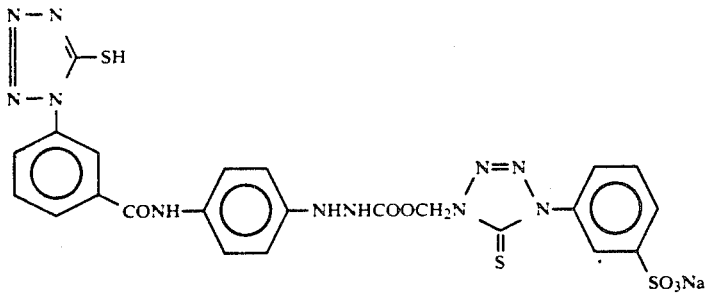
41.
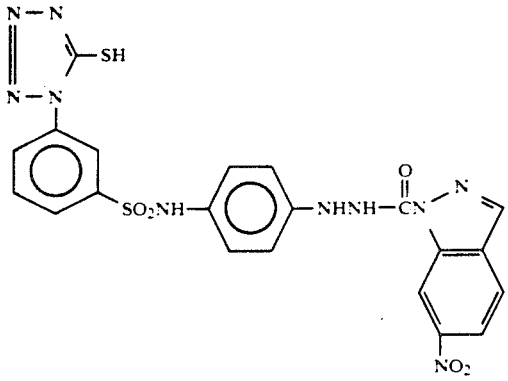
42.
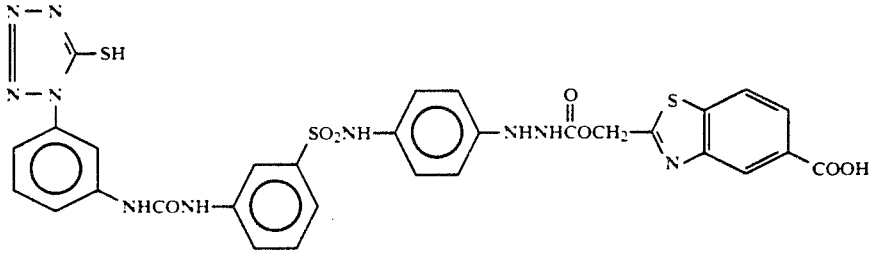
43.
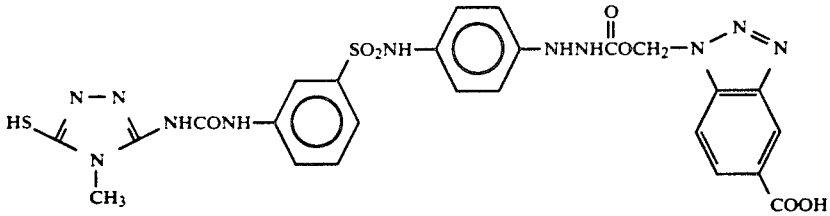
44.
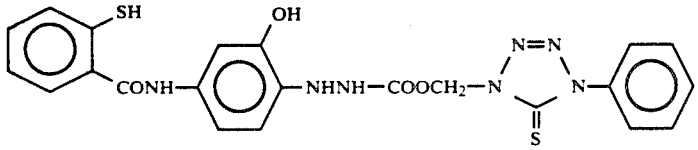

-continued
45.
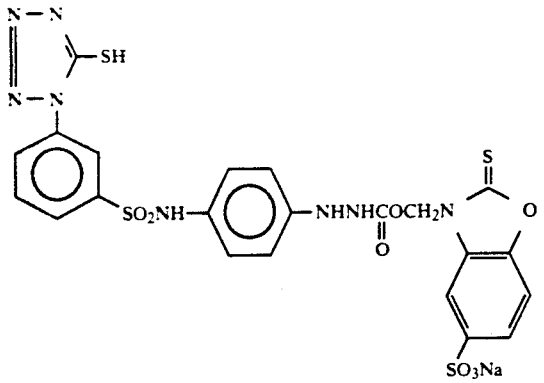
46.
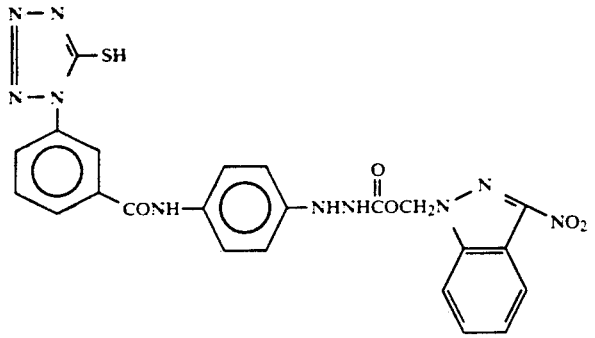
47.
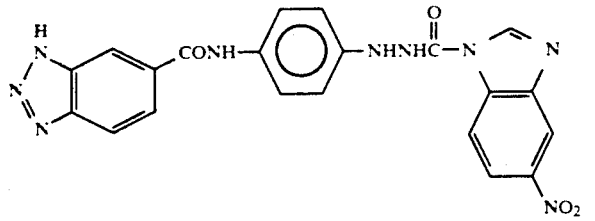
48.
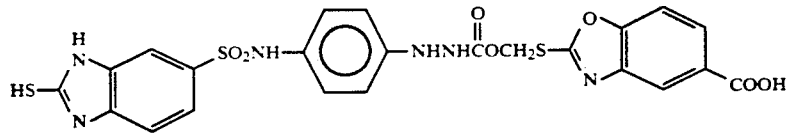
49.
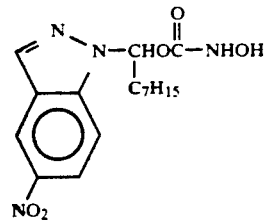
50.
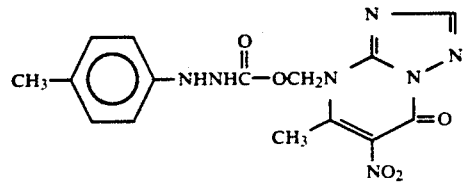

-continued

51.

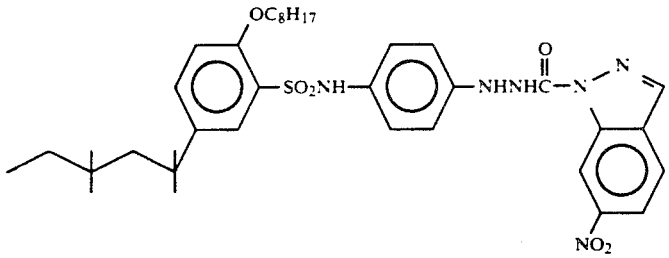

Redox compounds of this invention are used within the range $1.0\times10^{-7}$ to $1.0\times10^{-3}$ mol/m$^2$ and preferably of $1.0\times10^{-6}$ to $1.0\times10^{-4}$ mol/m$^2$.

Sythesis methods for the redox compound used in this invention are described in, for example, JP-A-61-213847, JP-A-62-260153, U.S. Pat. No. 4,684,604, JP-A-1-261936, U.S. Pat. Nos. 3,379,529, 3,620,746, 4,377,634, 4,332,878, JP-A-49-129536, JP-A-56-153336 and JP-A-56-153342.

When the redox compound is added to the emulsion, the redox compound may be added as a solution or it may be added by inclusion in fine polymer particles. From the standpoint of the stability of the coating solution (prevention of changes in photographic characteristics, prevention of precipitation in the coating solution etc.), when it is added as a solvent, it is extremely preferable that the redox compound be dissolved together with a melting-point-lowering agent in a water-miscible organic solvent such as methyl alcohol, ethyl alcohol, acetone, N,N-dimethylformamide, tetrahydrofuran or acetonitrile.

On the other hand, from the standpoint of the stability of the emulsion over time and the stability of the coating solution containing the said emulsion over time, when the redox agent is included in fine polymer particles, it is extremely preferable that the redox compound, melting-point-lowering agent and polymer are dissolved in a low-boiling organic solvent, emulsified and dispersed in an aqueous phase preferably a gelatin solution, and the low-boiling organic solvent is removed by distillation by heating under reduced pressure or the like.

Several methods of including a hydrophobic compound in fine polymer particles have been known hitherto. For example, methods in which a hydrophobic substance such as an oil-soluble coupler is dissolved in a water-miscible organic solvent and this solution is impregnated into a polymer by mixing it with a loadable polymer latex are disclosed in, for example, U.S. Pat. No. 4,203,716 (JP-B-58-35214), JP-B-60-56175, JP-A-54-32552, JP-A-53-126060, JP-A-53-137131, U.S. Pat. Nos. 4,201,589 and 4,199,363, DT-OLS 2,827,519, U.S. Pat. No. 4,304,769, EP 14921A and U.S. Pat. No. 4,247,627. Further, methods in which a hydrophobic compound is dissolved with a polymer of high-boiling organic solvent, emulsified and dispersed are described in, for example, JP-A-60-140344, DT-OLS 2,830,917, U.S. Pat. No. 3,619,195, JP-B-60-18978, JP-A-51-25133 and JP-A-50-102334.

The fine polymer grains containing the redox compound of this invention can be prepared by these known methods.

The following substances are preferred as the polymer which is essentially not soluble in water but is soluble in an organic solvent and is used in this invention, but the invention is not limited to these.

(A) Vinyl Polymers

The monomers which form vinyl polymers of this invention include acrylic acid esters and more specifically, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, t-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (number of moles of adduct n=9), 1-bromo-2-methoxyethyl acrylate and 1,1-dichloro-2-ethoxyethyl acrylate. In addition to these, the following monomers can be used.

Methacrylic acid esters: specific examples of these include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethylmethacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate, (number of moles of adduct n=6), allyl methacrylate, methacrylic acid, dimethylaminoethylmethyl chloride and the like.

Vinyl esters: specific examples including vinyl acetate, vinyl propionate, vinyl butyrate, vinyl isobutyrate, vinyl caproate, vinyl chloroacetate, vinyl methoxy acetate, vinyl phenyl acetate, vinyl benzoate, vinyl salicylate and the like;

acrylamides: such as acrylamide, methyl acrylamide, ethyl acrylamide, propyl acrylamide, butyl acrylamide, t-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, N-(2-acetoacetoxyet acrylamide, diacetone acrylamide, t-octyl acrylamide and the like;

methacrylamides: such as methacrylamide, methyl methacrylamide, ethyl methacrylamide, propyl methacrylamide, butyl methacrylamide, t-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide, N-(2-acetoacetoxyethyl)methacrylamide and the like;

olefins: such as dicyclopentadiene, ethylene, propylene, 1-butene, 1-pentene, vinyl chloride, vinylidene chloride, isoprene, chloroprene, butadiene, 2,3-dimethylbutadiene and the like;

styrenes: such as styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, vinyl benzoate methyl ester and the like;

vinyl ethers: such as methyl vinyl ether, butyl vinyl ether, hexyl vinyl ether, methoxyethyl vinyl ether, dimethylaminoethyl vinyl ether and the like;

as well as butyl crotonate, hexyl crotonate, dimethyl itaconate, dibutyl itaconate, diethyl maleate, dimethyl maleate, dibutyl maleate, diethyl furmarate, dimethyl furmarate, dibutyl furmarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalononitrile, vinylidene and the like.

Regarding the monomer (for example a monomer as mentioned above) used in the polymer of this invention, two or more may be used together as comonomers according to various objectives (for example, improving the solubility).

Further, for such purposes as solubility adjustment, monomers having an acidic group, examples of which are given below, may be used as comonomers provided that the copolymer does not become water soluble: acrylic acid; methacrylic acid; itaconic acid; maleic acid; monoalkyl itaconates such as monomethyl itaconate, monoethyl itaconate, monobutyl itaconate and the like; monoalkyl maleates such as monomethyl maleate, monoethyl maleate, monobutyl maleate and the like; citraconic acid; styrene sulfonic acid; vinylbenzylsulfonic acid; vinylsulfonic acid; acryloyloxyalkylsulfonic acids such as acryloyloxymethylsulfonic acid, acryloyloxyethylsulfonic acid, acryolyloxypropylsulfonic acid and the like; methacryloyloxyalkylsulfonic acids such as methacryloyloxymethylsulfonic acid, methacryloyloxyethylsulfonic acid, methacryloyloxypropylsulfonic acid and the like; acrylamidoalkylsulfonic acids such as 2-acrylamido-2-methylethanesulfonic acid, 2-methylpropanesulfonic acid, 2-acrylamido-2-methylbutanesulfonic acid and the like; methacrylamidoalkylsulfonic acids such as 2-methacrylamido-2-methylethanesulfonic acid, 2-methacrylamido-2-methylpropanesulfonic acid, 2-methacrylamido-2-methylbutanesulfonic acid and the like.

These acids may also take the form of salts of alkali metals (such as sodium and potassium) or ammonium ions.

Provided that the copolymer does not become water soluble, there are no particular limitations upon the proportion of the hydrophilic monomer in the copolymer when a vinyl monomer described drove and a hydrophilic monomer (here meaning one which becomes water soluble when made into a polymer by itself) among the other vinyl monomers used in this invention have been copolymerized. But it is normally preferable that the proportion is 40 mol.% or less of hydrophilic monomer, more preferably 20 mol.% or less and even more preferably 10 mol.% or less.

Further, when the hydrophilic comonomer which is copolymerized with a monomer of this invention possesses an acidic group, the proportion of the comonomer having the acidic group within the copolymer is normally 20 mol.% or less, preferably 10 mol.% or less. The case in which there is no such comonomer is most preferred.

The monomer of this invention in the polymer is preferably methacrylate-based, acrylamide-based or methacrylamide-based. It is particularly preferably acrylamide-based or methacrylamide-based.

(B) Polymers using Condensation Polymerization and Polyaddition Reactions

In general, polyamides using ω-amino-ω'-carboxyl acid and a dibasic acid and a diamine and polyesters using polybasic acids and polyhydric alcohols and the like are known as polymers made by condensation polymerization, and polyurethanes of dihydric alcohols and diisocyanate are known as polymers made by a polyaddition reaction.

Polyalkylene glycols or glycols having a structure consisting of $HO\text{-}R_1\text{-}OH$ (where $R_1$ is a hydrocarbon chain with 2 to about 12 carbon atoms, particularly an aliphatic hydrocarbon chain) are effective as polyhydric alcohols and substances having the structure $HOOC\text{-}R_2\text{-}COOH$ (where $R_2$ represents a single bond or a hydrocarbon chain with 1 to about 12 carbon atoms) are effective as polybasic acids.

Specific examples of polyhydric alcohols include ethylene glycol, diethylene glycol, triethylene glycol, 1,2-propylene glycol, 1,3-propylene glycol, trimethylolpropane, 1,4-butanediol, isobutylene diol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerine, diglycerine, triglycerine, 1-methylglycerine, erythritol, mannitol and sorbitol.

Specific examples of polybasic acids include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, furmaric acid, maleic acid, itaconic acid, citraconic acid, phthalic acid, isophthalic acid, terephthalic acid, tetrachlorophthalic acid, isopimelic acid, cyclopentadiene/maleic anhydride addition products and rosin/maleic anhydride addition products.

The diamines includes hydrazine, methylenediamine, ethylenediamine, trimethylendiamine, tetramethylenediamine, hexamethylenediamine, dodecylmethylenediamine, 1,4-diaminocylohexane, 1,4-diaminomethylcyclohexane, o-aminoaniline, p-aminoaniline, 1,4-diaminomethylbenzene and (4-aminophenyl)ether.

The ω-amino-ω-carboxylic acids include glycine, β-alanine, 3-aminopropanoic acid, 4-aminobutanoic acid, 5-aminopentanoic acid, 11-aminododecanoic acid, 4-aminobenzoic acid, 4-(2-aminoethyl)benzoic acid and 4-(4-aminophenyl)butanoic acid.

The diisocyanates include ethylene diisocyanate, hexamethylene diisocyanate, m-phenylene diisocyanate, p-phenylene diisocyanate, p-xylene diisocyanate and 1,5 naphthyl diisocyanate.

(C) Cellulose Derivatives

The cellulose derivatives which can be used in this invention include those which are soluble in the low-boiling non-water-miscible organic solvents for emulsification mentioned and are insoluble in water with a pH 7 at room temperature; examples include cellulose nitrate, cellulose acetate, cellulose acetate propionate, cellulose acetate butyrate, 2-hydroxypropyl methyl cellulose, and particularly preferably cellulose hydrogen phthalate derivates.

By way of example, cellulose hydrogen phthalate derivatives can be represented by the following general formula.

$$R^1{}_mR^2{}_nR^3{}_pR^4{}_qA$$

In the formula, A represents a glucose residual group in the cellulose structure, $R^1$ represents a hydroxyalkyl group with 2 to 4 carbon atoms, $R^2$ represents an alkyl group with 1 to 3 carbon atoms, $R^3$ represents the monoacyl group of tetrahydrophthalic acid or hexahydrophthalic acid, $R^4$ represents an aliphatic monoacyl group with 1 to 3 carbon atoms, m is 0 to 1.0, n is 0 to 2.0, p is 0.2 to 1.0, q is 0 to 2.0, and the total of m+n+p is a maximum of 3 (the numbers representing the number of moles).

Specific examples of $R^1$ include a 2-hydroxyethyl group, a 2-hydroxypropyl group and a 4-hydroxybutyl group.

Further, actual examples of $R^4$ include an acetyl group, a propionyl group, and a butyryl group.

Specific examples of cellulose hydrogen phthalate derivatives which can be used in this invention are given below, but the derivatives are not limited to these. The numbers between brackets in the compound examples are the number of moles of a substituent group to one glucose residual group.

(D) Others

By way of example, polyesters and polyamides obtained by ring-opening polymerization:

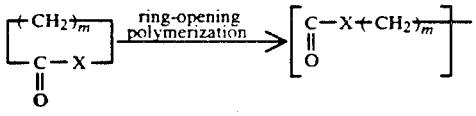

In the formula X represents —O— or —NH— and m is an integer of 4 to 7. —$CH_2$— may be branched. Such monomers include β-propiolactone, ε-caprolactone, dimethylpropiolactone, α-pyrrolidone, α-piperidone, ε-caprolactam and α-methyl-ε-caprolactam.

Two or more of the polymers of this invention described above may be used together if desired.

In this invention, a water-insoluble polymer refers to a polymer with a solubility of 3 g or less and preferably 1 g or less in 100 g of distilled water.

The oil-soluble polymer used in this invention is preferably one containing 30 to 70% of a constituent with a molecular weight of 40,000 or less.

Some specific examples of polymers used in this invention are given below, but the invention is not limited to these.

| Examples | Type of polymer |
|---|---|
| P-1) | Poly(vinyl acetate) |
| P-2) | Poly(vinyl propionate) |
| P-3) | Poly(methyl methacrylate) |
| P-4) | Poly(ethyl methacrylate) |
| P-5) | Poly(ethyl acrylate) |
| P-6) | Vinyl acetate/vinyl alcohol copolymer (95:5) |
| P-7) | Poly(n-butyl acrylate) |
| P-8) | Poly(n-butyl methacrylate) |
| P-9) | Poly(isobutyl methacrylate) |
| P-10) | Poly(isopropyl methacrylate) |
| P-11) | Poly(decyl methacrylate) |
| P-12) | Poly(butyl acrylate)/acrylamide copolymer (95:5) |
| P-13) | Poly(chloromethyl acrylate) |
| P-14) | 1,4-Butanediol/adipic acid polyester |
| P-15) | Ethylene glycol/sebacic acid polyester |
| P-16) | Poly(caprolactone) |
| P-17) | Poly(2-tert-butylphenyl acrylate) |
| P-18) | Poly(4-tert-butylphenyl acrylate) |
| P-19) | n-Butyl methacrylate/N-vinyl-2-pyrrolidone copolymer (90:10) |
| P-20) | Methyl methacrylate/vinyl chloride copolymer (70:30) |
| P-21) | Methyl methacrylate/styrene copolymer (90:10) |
| P-22) | Methyl methacrylate/ethyl acrylate copolymer (50:50) |
| P-23) | n-Butyl methacrylate/methyl methacrylate copolymer (50:50) |
| P-24) | Vinyl acetate/acrylamide copolymer (85:15) |
| P-25) | Vinyl chloride/vinyl acetate copolymer (65:35) |
| P-26) | Methyl methacrylate/acrylonitrile copolymer (65:35) |
| P-27) | Diacetone acrylamide/methyl methacrylate copolymer (50:50) |
| P-28) | Vinyl methyl ketone/isobutyl methacrylate copolymer (55:45) |
| P-29) | Ethyl methacrylate/n-butyl acrylate copolymer (70:30) |
| P-30) | Diacetone acrylamide/n-butyl acrylate copolymer (60:40) |
| P-31) | Methyl methacrylate/cyclohexyl methacrylate copolymer (50:50) |
| P-32) | n-Butyl acrylate/styrene methacrylate/diacetone acrylamide copolymer (70:20:10) |
| P-33) | N-tert-butyl methacrylate/methyl methacrylate/acrylic acid copolymer (60:30:10) |
| P-34) | Methylmethacrylate/styrene/vinyl sulfonamide copolymer (70:20:10) |
| P-35) | Methyl methacrylate/phenyl vinyl ketone copolymer (70:30) |
| P-36) | n-Butyl acrylate/methyl methacrylate/n-butyl methacrylate copolymer (35:35:30) |
| P-37) | n-Butyl acrylate/pentyl methacrylate/N-vinyl-2-pyrrolidone copolymer (38:38:24) |
| P-38) | Methyl methacrylate/n-butyl methacrylate/isobutyl methacrylate/acrylic acid copolymer (37:29:25:9) |
| P-39) | n-Butyl methacrylate/acrylic acid copolymer (95:5) |
| P-40) | Methyl methacrylate/acrylic acid copolymer (95:5) |
| P-41) | Benzyl methacrylate/acrylic acid copolymer (90:10) |
| P-42) | n-Butyl methacrylate/methyl methacrylate/benzyl methacrylate/acrylic acid copolymer (35:35:25:5) |
| P-43) | n-Butyl methacrylate/methyl methacrylate/benzyl methacrylate copolymer (35:35:30) |
| P-44) | Poly(3-pentyl acrylate) |
| P-45) | Cyclohexyl methacrylate/methyl methacrylate/n-propyl methacrylate copolymer (37:29:34) |
| P-46) | Poly(pentyl methacrylate) |
| P-47) | Methyl methacrylate/n-butyl methacrylate copolymer (65:35) |
| P-48) | Vinyl acetate/vinyl propionate copolymer (75:25) |
| P-49) | n-Butyl methacrylate/sodium 3-acryloxybutane-1-sulfonate copolymer (97:3) |
| P-50) | n-Butyl methacrylate/methyl methacrylate/acrylamide copolymer (35:35:30) |
| P-51) | n-Butyl methacrylate/methyl methacrylate/vinyl chloride copolymer (37:36:27) |
| P-52) | n-Butyl methacrylate/styrene copolymer (90:10) |
| P-53) | Methyl methacrylate/n-vinyl-2-pyrrolidone copolymer |

-continued

| Examples | Type of polymer |
|---|---|
| | (90:10) |
| P-54) | n-Butyl methacrylate/vinyl chloride copolymer (90:10) |
| P-55) | n-Butyl methacrylate/styrene copolymer (70:30) |
| P-56) | Poly(N-sec-butylacrylamide) |
| P-57) | Poly(N-tert-butylacrylamide) |
| P-58) | Diacetone acrylamide/methyl methacrylate copolymer (62:38) |
| P-59) | Poly(cyclohexyl methacrylate)methyl methacrylate copolymer (60:40) |
| P-60) | N-tert-Butyl acrylamide/methyl methacrylate copolymer (60:40) |
| P-61) | Poly(N-n-butyl acrylamide) |
| P-62) | Poly(tert-butyl methacrylate)N-tert-butyl acrylamide copolymer (50:50) |
| P-63) | tert-Butyl methacrylate/methyl methacrylate copolymer (70:30) |
| P-64) | Poly(N-tert-butyl methacrylamide) |
| P-65) | N-tert-Butyl acrylamide/methyl methacrylate copolymer (60:40) |
| P-66) | Methyl methacrylate/acrylonitrile copolymer (70:30) |
| P-67) | Methyl methacrylate/vinyl methyl ketone copolymer (38:62) |
| P-68) | Methyl methacrylate/styrene copolymer (75:25) |
| P-69) | Methyl methacrylate/hexyl methacrylate copolymer (70:30) |
| P-70) | Poly(benzyl acrylate) |
| P-71) | Poly(4-biphenyl acrylate) |
| P-72) | Poly(4-butoxycarbonylphenyl acrylate) |
| P-73) | Poly(sec-butyl acrylate) |
| P-74) | Poly(tert-butyl acrylate) |
| P-75) | Poly[3-chloro-2,2-(chloromethyl)propyl acrylate] |
| P-76) | Poly(2-chlorophenyl acrylate) |
| P-77) | Poly(4-chlorophenyl acrylate) |
| P-78) | Poly(pentachlorophenyl acrylate) |
| P-79) | Poly(4-cyanobenzyl acrylate) |
| P-80) | Poly(cyanoethyl acrylate) |
| P-81) | Poly(4-cyanoethyl acrylate) |
| P-82) | Poly(4-cyano-3-mercaptobutyl acrylate) |
| P-83) | Poly(cyclohexyl acrylate) |
| P-84) | Poly(2-ethoxycarbonylphenyl acrylate) |
| P-85) | Poly(3-ethoxycarbonylphenyl acrylate) |
| P-86) | Poly(4-ethoxycarbonylphenyl acrylate) |
| P-87) | Poly(2-ethoxyethyl acrylate) |
| P-88) | Poly(2-ethoxypropyl acrylate) |
| P-89) | Poly(1H,1H,5H-octafluoropentyl acrylate) |
| P-90) | Poly(heptyl acrylate) |
| P-91) | Poly(hexadecyl acrylate) |
| P-92) | Poly(hexyl acrylate) |
| P-93) | Poly(isobutyl acrylate) |
| P-94) | Poly(isopropyl acrylate) |
| P-95) | Poly(3-methoxybutyl acrylate) |
| P-96) | Poly(2-methoxycarbonylphenyl acrylate) |
| P-97) | Poly(3-methoxycarbonylphenyl acrylate) |
| P-98) | Poly(4-methoxycarbonylphenyl acrylate) |
| P-99) | Poly(2-methoxyethyl acrylate) |
| P-100) | Poly(4-methoxyphenyl acrylate) |
| P-101) | Poly(3-methoxypropyl acrylate) |
| P-102) | Poly(3,5-dimethyladamantyl acrylate) |
| P-103) | Poly(3-dimethylaminophenyl acrylate) |
| P-104) | Polyvinyl tert-butyrate |
| P-105) | Poly(2-methylbutyl acrylate) |
| P-106) | Poly(3-methylbutyl acrylate) |
| P-107) | Poly(1,3-dimethylbutyl acrylate) |
| P-108) | Poly(2-methylpentyl acrylate) |
| P-109) | Poly(2-naphthyl acrylate) |
| P-110) | Poly(phenyl methacrylate) |
| P-111) | Poly(propyl acrylate) |
| P-112) | Poly(m-tolyl acrylate) |
| P-113) | Poly(o-tolyl acrylate) |
| P-114) | Poly(p-tolyl acrylate) |
| P-115) | Poly(N,N-dibutyl acrylamide) |
| P-116) | Poly(isohexyl acrylamide) |
| P-117) | Poly(isooctyl acrylamide) |
| P-118) | Poly(N-methyl-N-phenyl acrylamide) |
| P-119) | Poly(adamantyl methacrylate) |
| P-120) | Poly(benzyl methacrylate) |
| P-121) | Poly(2-bromoethyl methacrylate) |
| P-122) | Poly(2-tert-butylaminoethyl methacrylate) |
| P-123) | Poly(sec-butyl methacrylate) |
| P-124) | Poly(tert-butyl methacrylate) |
| P-125) | Poly(2-chloroethyl methacrylate) |

-continued

| Examples | Type of polymer |
|---|---|
| P-126) | Poly(2-cyanoethyl methacrylate) |
| P-127) | Poly(2-cyanomethylphenyl methacrylate) |
| P-128) | Poly(4-cyanophenyl methacrylate) |
| P-129) | Poly(cyclohexyl methacrylate) |
| P-130) | Poly(dodecyl methacrylate) |
| P-131) | Poly(diethylaminoethyl methacrylate) |
| P-132) | Poly(2-ethylsulfinylethyl methacrylate) |
| P-133) | Poly(hexadecyl methacrylate) |
| P-134) | Poly(hexyl methacrylate) |
| P-135) | Poly(2-hydroxypropyl methacrylate) |
| P-136) | Poly(4-methoxycarbonylphenyl methacrylate) |
| P-137) | Poly(3,5-dimethyladamantyl methacrylate) |
| P-138) | Poly(dimethylaminoethyl methacrylate) |
| P-139) | Poly(3,3-dimethylbutyl methacrylate) |
| P-140) | Poly(3,3-dimethyl-2-butyl methacrylate) |
| P-141) | Poly(3,5,5-trimethylhexyl methacrylate) |
| P-142) | Poly(octadecyl methacrylate) |
| P-143) | Poly(tetradecyl methacrylate) |
| P-144) | Poly(4-butoxycarbonylphenylmethacrylamide) |
| P-145) | Poly(4-carboxyphenylmethacrylamide) |
| P-146) | Poly(4-ethoxycarbonylphenylmethacrylamide) |
| P-147) | Poly(4-methoxycarbonylphenylmethacrylamide) |
| P-148) | Poly(butylbutoxycarbonyl methacrylate) |
| P-149) | Poly(butyl chloroacrylate) |
| P-150) | Poly(butyl cyanoacrylate) |
| P-151) | Poly(cyclohexyl chloroacrylate) |
| P-152) | Poly(chloroethyl acrylate) |
| P-153) | Poly(ethylethoxycarbonyl methacrylate) |
| P-154) | Poly(ethyl ethacrylate) |
| P-155) | Poly(fluoroethyl methacrylate) |
| P-156) | Poly(hexylhexyloxycarbonyl methacrylate) |
| P-157) | Poly(chloroisobutyl acrylate) |
| P-158) | Poly(isopropyl chloroacrylate) |
| P-159) | Trimethylenediamine/glutaric acid polyamide |
| P-160) | Hexamethylenediamine/adipic acid polyamide |
| P-161) | Poly(α-pyrrolidone) |
| P-162) | Poly(ε-caprolactam) |
| P-163) | Hexamethylene diisocyanate-1,4-zitane diol polyurethane |
| P-164) | p-Phenylene diisocyanate/ethylene glycol polyurethane |
| P-165) | Poly(vinyl hydrogen phthalate) |
| P-166) | Poly(vinyl acetal phthalate) |
| P-167) | Poly(vinyl acetal) |
| P-168) | 2-Hydroxypropyl methyl cellulose hexahydrophthalate (2-hydroxypropyl group . . . 0.28, methyl group . . . 1.65, hexahydrophthalyl group . . . 0.60) |
| P-169) | 2-Hydroxypropyl methyl cellulose hexahydrophthalate (2-hydroxypropyl group . . . 0.33, methyl group . . . 1.60, hexahydrophthalyl group . . . 0.69) |
| P-170) | 2-Hydroxypropyl methyl cellulose hexahydrophthalate (2-hydroxypropyl group . . . 0.22, methyl group . . . 1.81, hexahydrophthalyl group . . . 0.84) |
| P-171) | Cellulose acetate hexahydrophthalate (acetyl group . . . 1.23, hexahydrophthalyl group . . . 0.67) |
| P-172) | 2-Hyroxypropyl 4-hydroxybutyl methyl cellulose hexahydrophthalate (2-hydroxypropyl group . . . 0.28, 4-hydroxybutyl group . . . 0.06, methyl group . . . 1.53, hexahydrophthalyl group . . . 0.39) |
| P-173) | 2-Hydroxypropyl ethyl cellulose tetrahydrophthalate (2-hydroxypropyl group . . . 0.44, ethyl group . . . 0.92, tetrahydrophthalyl group . . . 0.41) |
| P-174) | 2-Hydroxypropyl methyl cellulose acetate hexahydrophthalate (2-hydroxypropyl group . . . 0.16, methyl group . . . 1.50, acetyl group . . . 0.42, hexahydrophthalyl group . . . 0.68) |

These compounds can be prepared by known methods such as the methods described in, for example, U.S. Pat. No. 3,392,022 and JP-B-49-17367.

P-175) tert-Butylacrylamide/polyoxyethylene methacrylate copolymer (90:10): for polyoxyethylene, n=1-50.

SYNTHESIS EXAMPLE (1)

Synthesis of a Methyl Methacrylate Polymer (P-3)

Fifty g of methyl methacrylate, 0.5 g of sodium polyacrylate, 0.1 g of dodecyl mercaptan and 200 ml of distilled water were placed in a 500 ml three-necked flask and heated to 80° C. with stirring in a nitrogen stream. Five hundred mg of azobis(dimethyl isobutyrate) were added as a polymerization initiator and polymerization commenced.

After 2 hours of polymerization, 48.7 g of P-3 were obtained by cooling the polymer liquid, and filtering and washing the polymer which was in the form of beads. Molecular weight measurements by GPC revealed constituents with a molecular weight of 40,000 or less to constitute 53%.

SYNTHESIS EXAMPLE (2)

Synthesis of a T-Butylacrylamide Polymer (P-57)

A mixture of 50 ml of isopropyl alcohol, 250 ml of toluene and 50.0 g of t-butylacrylamide were placed in a 500 ml three-necked flask and heated to 80° C with stirring in a nitrogen stream.

Ten ml of a toluene solution containing 500 mg of azobis(isobutyronitrile) were added as a polymerization initiator and polymerization commenced.

After 3 hours of polymerization, 47.9 g of P-57 were obtained by cooling the polymer liquid, filtering off the solids which precipitated upon pouring into 1 l of hexane, washing with hexane and then drying by heating under reduced pressure.

Molecular weight measurements by GPC revealed that consitutents with a molecular weight of 40,000 or less constituted 36%.

Methods for including the hydrazine derivatives of this invention in fine polymer particles include, for example, (1) the method in which a redox compound and melting-point-lowering agent are impregnated (loaded) into a polymer by dissolving the hydrazine derivative in a water-miscible organic solvent, and mixing the resulting solution with a loadable polymer latex, and (2) the method in which a redox compound, melting-point-lowering agent and polymer are dissolved in a low-boiling organic solvent which is not soluble in water (with a solubility of 30% or less in water), and emulsification and dispersion are carried out in the aqueous phase (at which time gelatin and an auxiliary emulsifier such as a surfactant may be used if required). In both cases, after the redox compound and the melting-point-lowering agent have been incorporated into the fine polymer particles, it is preferable to remove any superfluous organic solvent from the standpoint of stability during storage. Further, when the former method is used, while there is the advantage that, unlike emulsification and dispersion, a great amount of power will not be needed when the redox compound and melting-point-lowering agent are incorporated into the fine polymer particles, it is difficult to incorporate large amounts of redox compound and melting-point-lowering agent in the polymer. On the other hand, the latter method is preferred as the dispersion method since, although it requires a large amount of power for emulsification and dispersion, it is more advantageous than the former method since it is possible to incorporate large amounts of redox compound and melting-point-lowering agent in the polymer. Additionally, by adjusting the size of the polymer particles and the like, the reactivity of the redox compound is adjusted and it is possible to incorporate several redox compounds with differing photographic properties uniformly in the fine polymer particles in any desired percentage.

A dispersion of the fine polymer particles containing the redox compounds and melting-point-lowering agents of this invention is prepared as outlined below.

A redox compound, melting-point-lowering agent and polymer are completely dissolved together in a low-boiling organic solvent and then the resulting solution is put into a coating solution by using ultrasonic waves, a colloid mill, a dissolver or the like to disperse it in a fine particulate form in water, or preferably in an aqueous solution of a hydrophilic colloid and more preferably in an aqueous gelatin solution, using an auxiliary dispersant such as a surfactant if required.

From the point of view of the stability of the dispersion which has been prepared, it is preferable to remove the low-boiling organic solvent from the dispersion. Methods for removing the low-boiling organic solvent include distilling by heating under reduced pressure, distilling at normal pressure with heating under a gas atmosphere of nitrogen, argon or the like, nudel washing, ultrafiltration and the like.

"A low-boiling organic solvent" as referred to herein refers to an organic solvent which is useful during the emulsification and dispersion, which is ultimately substantially removed from the photosensitive material by the drying stage during coating or the abovementioned methods or the like, and to a solvent which can be removed by washing or the like and has a certain degree of solubility in water or an organic solvent with a low boiling point.

Low-boiling organic solvents include ethyl acetate, butyl acetate, ethyl propionate, secondary butyl alcohol, methyl ethyl ketone, methyl isobutyl ketone, β-ethoxyether acetate, methyl Cellosolve acetate and cyclohexanone.

Moreover, when required it is also possible to use a portion of an organic solvent which mixes completely with water such as methyl alcohol, ethyl alcohol, acetone and tetrahydrofuran.

Two or more types of these organic solvents can also be used in combination.

The average particle size of the particles in the emulsion obtained in this way is preferably 0.02 μm to 2 μm and more preferably 0.04 μm to 0.4 μm. The particle size of the particles in the emulsion can be measured by a measuring apparatus such as the Nanosizer made by the U.S. Company Coulter.

The abovementioned polymer of this invention is normally preferably used within a range of 10–400% by weight and particularly preferably of 20–300% by weight with respect to the redox compound.

It is extremely preferable for a melting-point-lowering agent to be present when the redox compound is incorporated into the polymer particles.

The "melting-point-lowering agent" as used in this invention is essentially non-diffusible and signifies an organic compound which is essentially insoluble in water and has the effect of lowering the melting point of the oil-soluble redox compound when it is mixed with the redox compound.

The melting-point-lowering agents shown by the following general formulae (II) and (II') are preferred as those used in this invention:

General Formula (II)

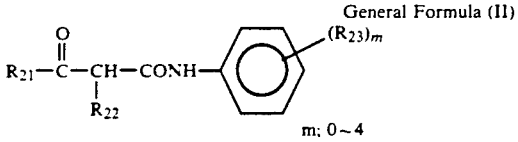

In the formula, $R_{21}$ represents a substituted or unsubstituted alkyl group or a substituted or unsubstituted phenyl group. $R_{22}$ represents a hydrogen atom, a halogen atom, a 5-membered hetero ring system or a substituted or unsubstituted phenoxy group. $R_{23}$ represents a halogen atom, a carbonyl group, a carboxyl group, an acylamino group or a sulfonamino group.

Specific examples of compounds represented by general formula (II) are given below. However, this invention is not limited to the following compounds:

II-1)

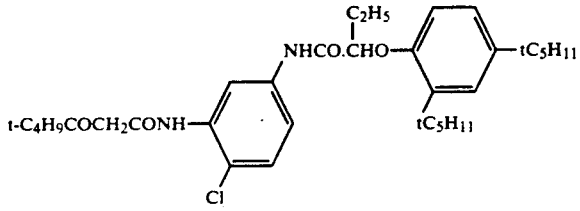

II-2)

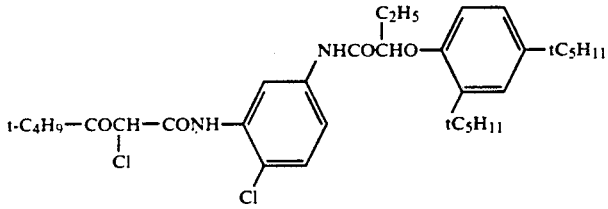

II-3)

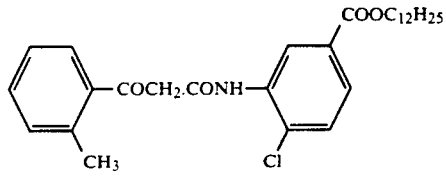

II-4)

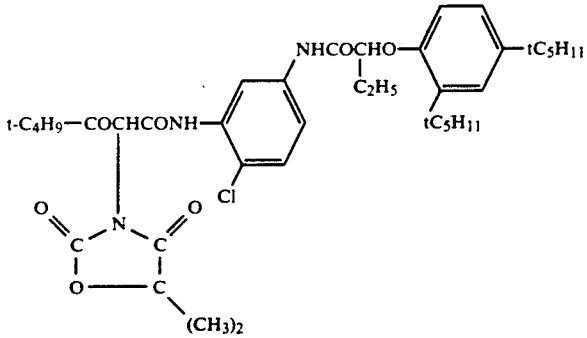

II-5)

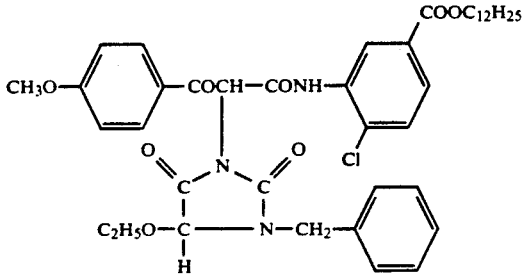

-continued
II-6)
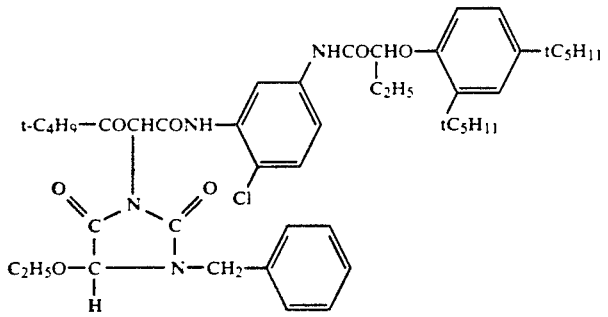
II-7)
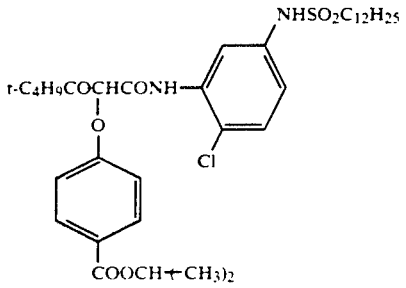
II-8)
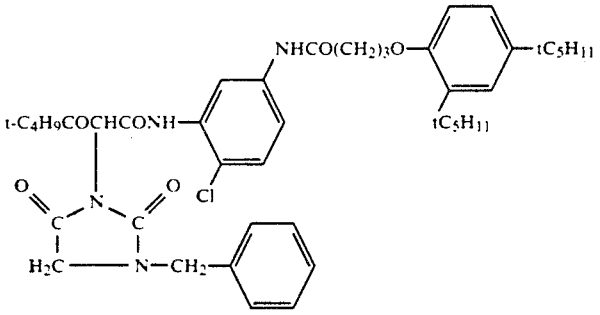
II-9)
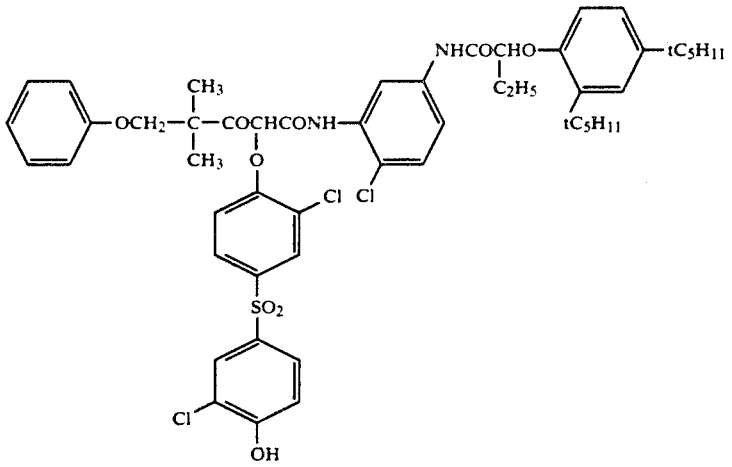

-continued
II-10)
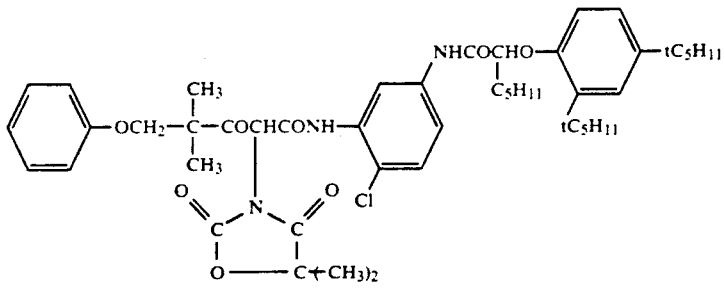
II-11)
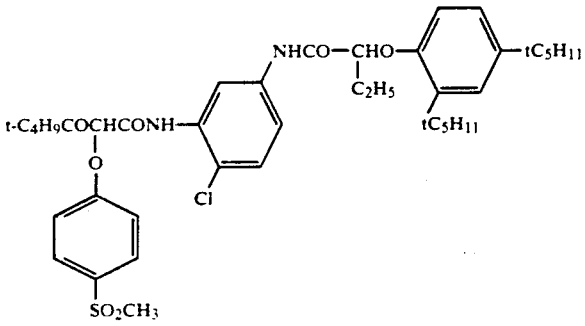
II-12)
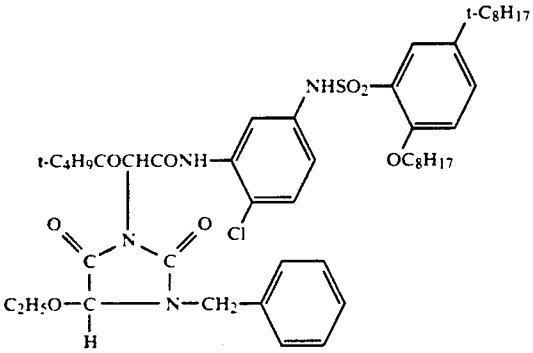
II-13)
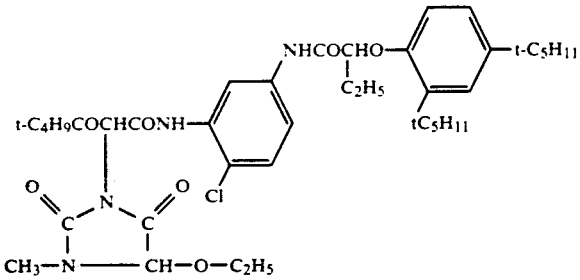
II-14)
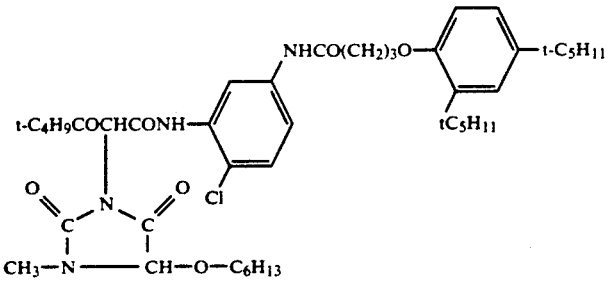
General Formula (II')
$Z_1-Q$
In the formula $Z_1$ represents an aliphatic group or an aromatic group, Q represents a hydrogen atom, substituted or unsubstituted alkyl group with 20 carbon atoms or less or a substituted or unsubstituted phenyl group with 20 carbon atoms or less.

In general formula (II'), the aliphatic group or aromatic group represented by $Z_1$ is preferably one which can be represented by the following formula:

$$Z_3-L-$$

Here, $Z_3$ represents a substituted or unsubstituted alkyl group with 8-70, and preferably 8-30 carbon atoms, or a substituted phenyl group with 8-70, and preferably 8-30 carbon atoms. L represents a divalent linking group (for example alkylene, ether, carboxamido, carbamoyl, sulfamoyl, sulfonamido, carbonyl, sulfone, —S, —SO— or combinations thereof).

Substituent groups for the alkyl groups of $Z_3$ include an aryl group, an alkoxy group, a sulfonamido group and a carboxamido group. Substituent groups for the substituted phenyl groups of $Z_3$ include an alkyl group, an aralkyl group, an alkoxy group, a substituted amino group, an acylamino group, an sulfonamido group and a ureido group.

An alkyl-substituted phenoxyalkanamido group is most prefrrred as $Z_1$.

The main compounds of those included in general formula (II') are given below:

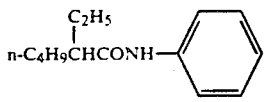

II'-1

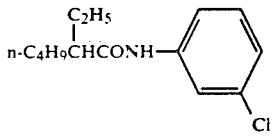

II'-2

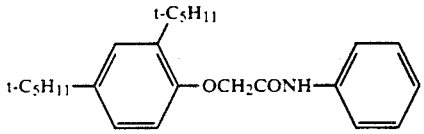

II'-3

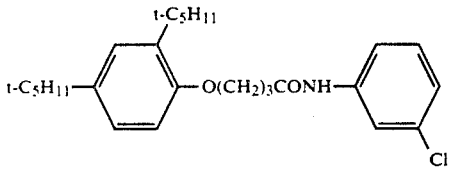

II'-4

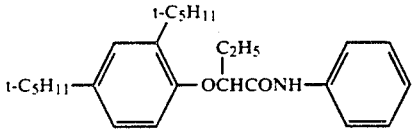

II'-5

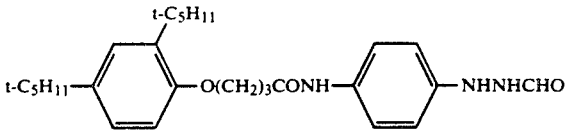

II'-6

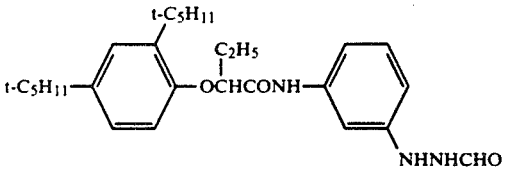

II'-7

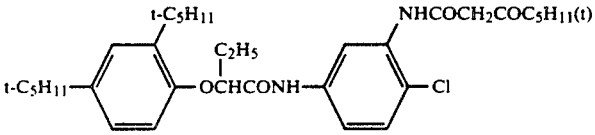

II'-8

-continued

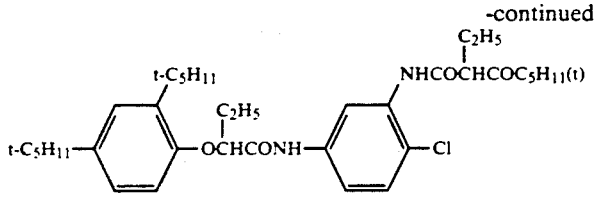

II'-9

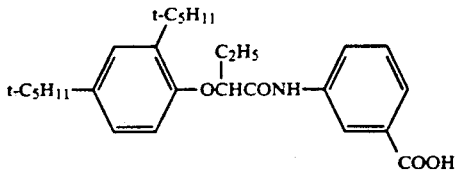

II'-10

Many of the compounds represented by general formulae (II) and (II') are known compounds and can be easily synthesized by a person skilled in the art of organic synthesis.

The average particle size of the particles in the emulsion containing the redox compound, melting-point-lowering compound and polymer is preferably 0.02 μm to 2 μm and more preferably 0.04 μm to 0.4 μm. The particle size of the particles in the emulsion can be measured by a measuring apparatus such as the Nanosizer made by the United States Company Coulter.

Various hydrophobic photographic substances can be included in the fine polymer particles in the emulsion of this invention within a range such that the redox compound adequately fulfills its intended purpose.

Examples of hydrophobic photographic substances include high-boiling organic solvents, colored couplers, colorless couplers, developing agents, precursors of developing agents, ultraviolet absorbers, development accelerators, gradation adjusters such as hydroquinones, dyes, dye-releasing agents, antioxidants, fluorescent brighteners and antifoggants. Further, these hydrophobic substances may be used in combination.

The abovementioned redox compounds of this invention are normally used within the range $10^{-6}$ to $2\times10^{-1}$, and preferably $10^{-5}$ to $1\times10^{-1}$, mole per mole of silver. Further, the redox compound may be used alone or in combinations of two or more others.

The abovementioned melting-point-lowering agent in this invention is normally preferably used within a range of 10 to 200 wt.%, and particularly preferably of 20 to 100 wt.% with respect to the redox compound. The abovementioned polymer in this invention is normally preferably used within a range of 10 to 400 wt.%, and particularly preferably 20 to 300 wt.% with respect to the redox compound.

The layer containing the fine polymer particles which contain the redox compound and melting-point-lowering agent of this invention is provided as a layer above or below the photosensitive emulsion layer which contains a hydrazine nucleating agent. The layer containing the fine polymer particles containing the redox compound and melting-point-lowering agent of this invention may also contain photosensitive or non-photosensitive silver halide emulsion grains. An intermediate layer containing gelatin or a synthetic polymer such as poly(vinyl acetate), poly(vinyl alcohol) or the like, may be provided between the layer containing the fine polymer particles containing the redox compound and melting-point-lowering agent of this invention and the photosensitive emulsion layer containing a hydrazine nucleating agent.

The hydrazine derivative used in this invention is preferably a compound represented by the following general formula (III):

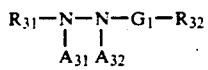

General Formula (III)

In the formula $R_{31}$ represents an aliphatic group or an aromatic group, $R_{32}$ represents a hydrogen atom, an alkyl group, an aryl group, an alkoxy group, an aryloxy group, an amino group, a hydrazino group, a carbamoyl group or an oxycarbonyl group, and $G_1$ represents a carbonyl group, a sulfonyl group, a sulfoxy group,

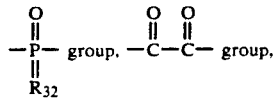

a thiocarbonyl group or an iminomethylene group, $A_{31}$ and $A_{32}$ both represent hydrogen atoms or one represents a hydrogen atom and the other a substituted or unsubstituted alkylsulfonyl group, a substituted or unsubstituted alkylsulfonyl group, a substituted or unsubstituted arylsufonly group or a substituted or unsubstituted acyl group.

In general formula (III), the aliphatic group represented by $R_{31}$ is preferably one with 1-30 carbon atoms, and particularly preferably a straight-chain, branched or cyclic alkyl group with 1-20 carbon atoms. Here, the branched alkyl group may cyclized in such a way as to form a saturated hetero ring system containing one or more heteroatoms within it. Further, the alkyl group may contain substituent groups such as an aryl group, an alkoxy group, a sulfoxy group, a sulfonamido group or a carboxamido group.

In general formula (III), the aromatic group represented by $R_{31}$ is a monocyclic or bicyclic aryl group or an unsaturated hetero ring system. The unsaturated hetero ring system may form a heteroaryl group by fusing with a monocyclic or bicyclic aryl group.

By way of example, there are benzene rings, naphthalene rings, pyridine rings, pyrimidine rings, imidazole rings, pyrazole rings, quinoline rings, isoquinoline rings, benzimidazole rings, thiazole rings, benzothiazole rings and the like, and of these, those containing a benzene ring are preferred.

An aryl group is particularly preferred as $R_{31}$.

The aryl group or unsaturated hetero ring system for $R_{31}$ may be substituted, and representative substituent group include, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sufinyl group, a hydroxyl group, a halogen atoms, a cyano group, a sulfo group, an alkyloxycarbonyl group, an aryloxycarbonyl group, an acyl group, an alkoxycarbonyl group, an acyloxy group, a carboxamido group, a sulfonamido group, a carboxyl group, a phosphoramido group, a diacylamino group, an imido group,

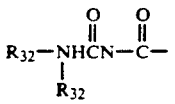

group, and the like. Preferred substituent groups include straight-chain, branched or cyclic alkyl groups (preferably with 1-20 carbon atoms), aralkyl groups (preferably monocyclic or bicyclic ones with 1-3 carbon atoms in the alkyl moiety), alkoxy groups (preferably with 1-20 carbon atoms), substituted amino groups (preferably amino groups substituted with an alkyl group with 1-20 carbon atoms), acylamino groups (preferably with 2-30 carbon atoms), sulfonamido groups (preferably with 1-30 carbon atoms), ureido groups (preferably with 1-30 carbon atoms) and phosphoramido groups (preferably with 1-30 carbon atoms).

In general formula (III), the alkyl group represented by $R_{32}$ is preferably an alkyl group with 1-4 carbon atoms and may be substituted with, for example, halogen atoms, a cyano group, a carboxy group, a sulfo group, an alkoxy group, a phenyl group, an acyl group, an alkoxycarbonyl group, an aryloxycarbonyl group, a carbamoyl group, an alkylsulfo group, arylsulfo group, a sulfamoyl group, a nitro group, a heterocyclic aromatic ring system or

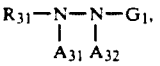

and these substituents may be further substituted.

A monocyclic or bicyclic aryl group is preferred as the aryl group, for example one including a benzene ring. This aryl group may be substituted, examples of substituent groups being the same as for the alkyl group.

An alkoxy group with 1-8 carbon atoms is preferred as the alkoxy group which may be substituted with halogen atoms, an aryl group or the like.

A monocyclic aryloxy group is preferred as the aryloxy group, substituents including halogen atoms.

An unsubstituted amino group, or an arylamino group or an alkylamino group with 1-10 carbon atoms is preferred as the amino group which may be substituted with an alkyl group, halogen atom, cyano group, nitro group, carboxy group or the like.

An unsubstituted carbamoyl group and an arylcarbamoyl group or an alkylcarbamoyl group with 1-10 carbon atoms is preferred as the carbamoyl group, and this may be substituted with an alkyl group, a halogen atom, a cyano group, a carboxy group or the like.

An aryloxycarbonyl group or an alkoxycarbonyl group with 1-10 carbon atoms is preferred as the oxycarbonyl group, and this may be substituted with an alkyl group, halogen atom, cyano group, nitro group or the like.

When $G_1$ is a carbonyl group, groups which are preferred as the group represented by $R_{32}$ include a hydrogen atom, an alkyl group (for example methyl, trifluoromethyl, 3-hydroxypropyl,3-methanesulfonamidopropyl and phenylsulfonylmethyl), an aralkyl group (for example o-hydroxybenzyl), and an aryl group (for example, phenyl, 3,5-dichlorophenyl, o-methanesulfonamidophenyl and 4-methanesulfonylphenyl). A hydrogen atom is particularly preferred.

Further, when $G_1$ is a sulfonyl group, $R_{32}$ is preferably an alkyl group (for example methyl), an aralkyl group (for example, o-hydroxyphenylmethyl), an aryl group (for example phenyl) or a substituted amino group (for example dimethylamino) or the like.

When $G_1$ is a sulfoxy group, $R_{32}$ is preferably a cyanobenzyl group, a methylthiobenzyl group or the like, and when $G_1$ is the

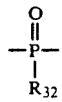

group, $R_{32}$ is preferably a methoxy group, an ethoxy group, a butoxy group, a phenoxy group or a phenyl group. The phenoxy group is particularly desirable.

When $G_1$ is a N-substituted or unsubstituted iminomethylene group, $R_{32}$ is preferably a methyl group, an ethyl group or a substituted or unsubstituted phenyl group.

The substituent groups listed in connection with $R_{31}$ can be appropriately used as substituent groups for $R_{32}$.

A carbonyl group is most preferred as G in general formula (III).

Further, $R_{32}$ may be a group which cleaves the $G_1$—$R_{32}$ moiety from the remaining molecule and gives rise to a cyclizing reaction which produces a cyclic structure containing the atoms of the —$G_1$—$R_{32}$ moiety, or more specifically the sort of group which can be represented by general formula (a): General Formula (a)

$$-R_{33}-Z_{11}$$

In the formula, $Z_{11}$ is a group which attacks $G_1$ nucleophilically and is able to cleave the $G_1$—$R_{33}$—$Z_{11}$ moiety from the remaining molecule, and $R_{33}$ is a group in which one hydrogen atom has been removed from $R_{32}$, and it is possible to produce a cyclic structure from $G_1$, $R_{33}$ and $Z_{11}$ when $Z_{11}$ attacks $G_1$ nucleophilically.

More specifically $Z_{11}$ is a group which readily undergoes a nucleophilic reaction with $G_1$ when a hydrazine compound of general formula (III) has produced the following reaction intermediate by oxidation or the like:

$$R_{31}-N=N-G_1-R_{33}-Z_{11}$$

and can cleave the group $R_{31}$—N=N from $G_1$; and more specifically it may be a functional group which reacts directly with $G_1$ such as OH, SH or $NHR_4$ (where $R_4$ is a hydrogen atom, alkyl group, aryl group, —$COR_5$ or —$SO_2R_5$, where $R_5$ is a hydrogen atom, alkyl group, aryl group, heterocyclic group or the like) or COOH (and here the OH, SH, $NHR_4$ and —COOH may be temporarily protected so as to form these groups by hydrolysis with an alkali or the like), or alternatively it may be a functional group which can react with $G_1$ by the reaction of nucleophilic agents such as hydroxyl ions and sulfite ions, such as $$-\overset{O}{\overset{\|}{C}}-R_6 \text{ and } -\overset{N-R_7}{\overset{\|}{C}}-R_6$$

(where $R_6$ and $R_7$ represent hydrogen atoms, alkyl groups, alkenyl groups, aryl groups or heterocyclic groups).

Further, the ring system which is formed by $G_1$, $R_3$ and $Z_{11}$ is preferably a 5-membered or 6-membered ring system.

Of the structures represented by general formula (a), those which can be represented by general formulae (b) and (c) are preferred:

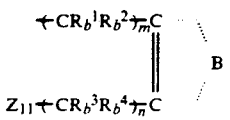

General Formula (b)

In the formula, $R^1{}_b$ to $R^4{}_b$ may be identical or different and represent hydrogen atoms, alkyl groups (preferably with 1-12 carbon atoms), alkenyl groups, (preferably with 2-12 carbon atoms), aryl groups (preferably with 6-12 carbon atoms) and the like. B is a group of atoms necessary to complete a 5-membered ring or 6-membered rings which may have substituent groups, m and n are 0 or 1 and (n+m) is 1 or 2.

Five-membered or 6-membered rings formed by B include, for example, cyclohexene rings, cycloheptene rings, benzene rings, naphthalene rings, pyridine rings and quinoline rings.

$Z_{11}$ has the same significance as in general formula (a).

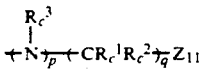

General Formula (c)

In the formula, $R_c{}^1$ and $R_c{}^2$ are identical or different and represent hydrogen atoms, alkyl groups, alkenyl groups, aryl groups or halogen atoms.

$R_c{}^3$ represents a hydrogen atom, an alkyl group, an alkenyl group or an aryl group.

p may be 0 or 1, q is 1 to 4.

$R_c{}^1$, $R_{c2}$ and $R_{c3}$ may link to form a ring provided that it has a structure whereby $Z_{11}$ is able to subject $C_1$ to an intramolecular nucleophilic attack.

$R_c{}^1$ and $R_c{}^2$ are preferably hydrogen atoms, halogen atoms or alkyl groups, and $R_c{}^3$ is preferably an alkyl group or an aryl group.

q is preferably 1-3, and when q is 1 p represents 0 or 1, when q is 2 p represents 0 or 1, and when q is 3 p represents 0 or 1, when q is 2 or 3 $R_c{}^1$ and $R_c{}^2$ may be identical or different, $Z_{11}$ has the same significance as in general formula (a).

$A_{31}$ and $A_{32}$ are preferably hydrogen atoms, arylsufonyl groups or alkylsulfonyl groups with 20 or less carbon atoms (preferably a phenylsulfonyl group or a phenylsulfonyl group which has been substituted such that the sum of the Hammett constants of the substituent groups is −0.5 or more), acyl groups with 20 or less carbon atoms (preferably a benzoyl group, a benzoyl group which has been substituted such that the sum of Hammett constants of the substituent groups is −0.5 or more, or a substituted or unsubstituted straight-chain, branched or cyclic aliphatic acyl group (the substituents including, for example, halogen atoms, an ether group, sulfonamido group, carbonamido group, hydroxyl group, carboxy group or sulfonic acid group)).

Hydrogen atoms are most preferred for $A_{31}$ and $A_{32}$.

Polymers or ballast groups normally used in non-transferrable photographic additives such as couplers may be combined in $R_{31}$ or $R_{32}$ in general formula (III). The ballast group is a comparatively photographically inactive group which has 8 or more carbon atoms, and may be, for example, an alkyl group, an alkoxy group, a phenyl group, an alkylphenyl group, a phenoxy group or an alkylphenoxy group. By way of example, the polymers described in JP-A-1-100530 may be mentioned as such polymers.

A group which reinforces adsorption to silver halide grain surfaces may be incorporated into $R_{31}$ or $R_{32}$ in general formula (III). Such adsorption groups include the thiourea groups, heterocyclic thioamido groups, heterocyclic mercapto groups, triazole groups and the like described in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246.

Specific examples of compounds represented by general formula (III) are given below. However, this invention is not limited to the following compounds.

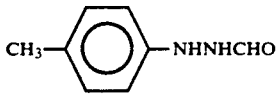

III-1)

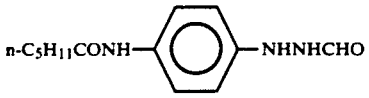

III-2)

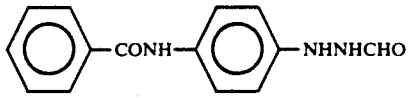

III-3)

-continued
III-4)
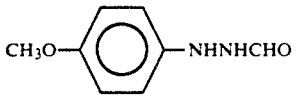
III-5)
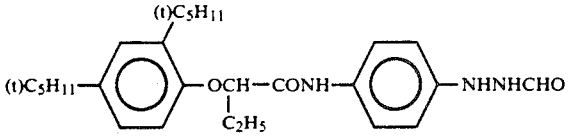
III-6)
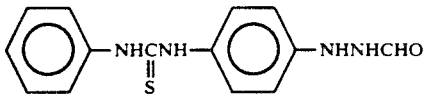
III-7)
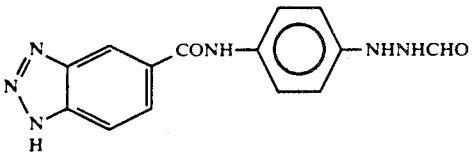
III-8)
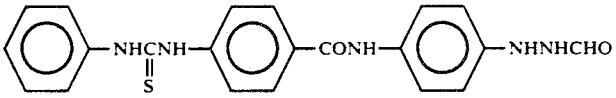
III-9)
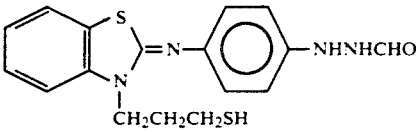
III-10)
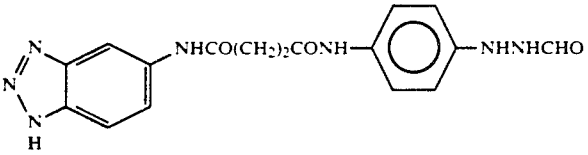
III-11)
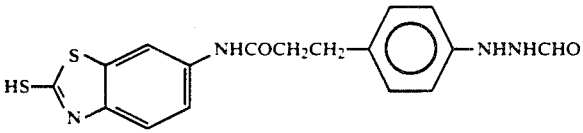
III-12)
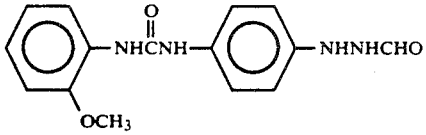
III-13)
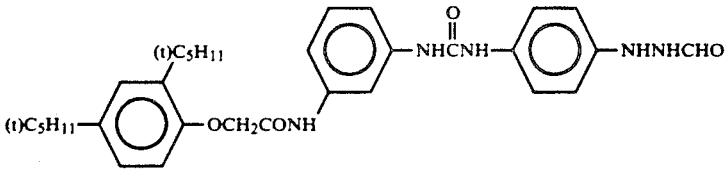
III-14)
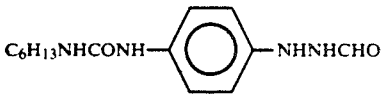

-continued
III-15)
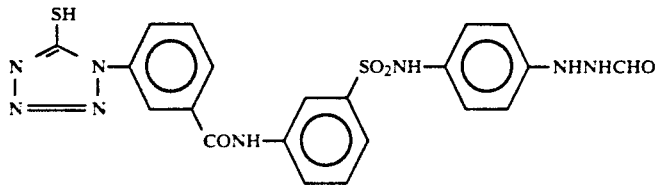
III-16)
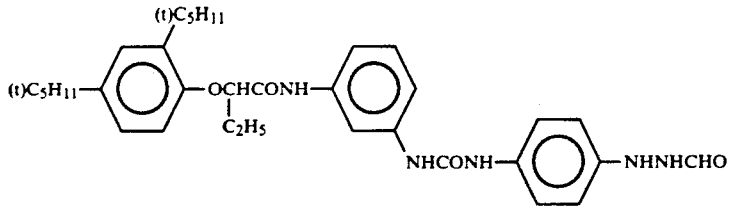
III-17)
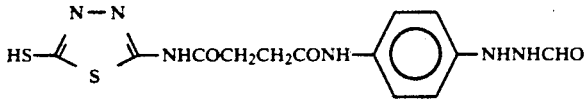
III-18)
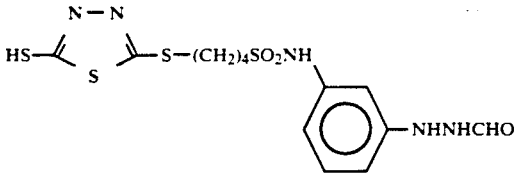
III-19)
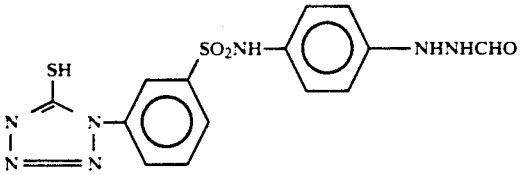
III-20)
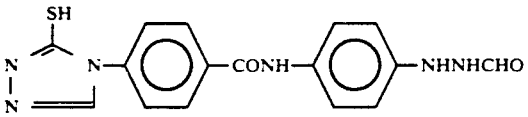
III-21)
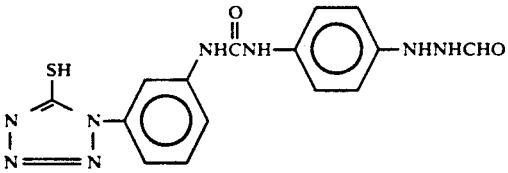
III-22)
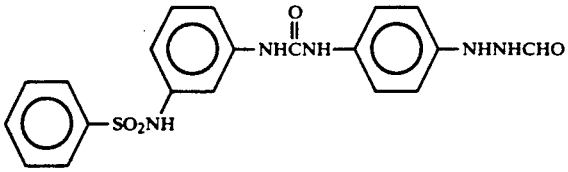
III-23)
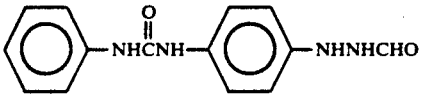
III-24)
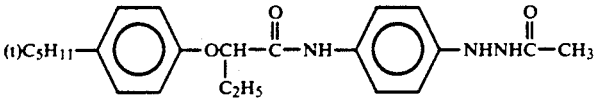

-continued
III-25)
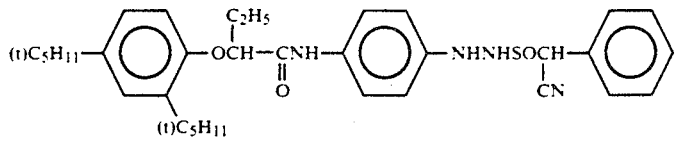
III-26)
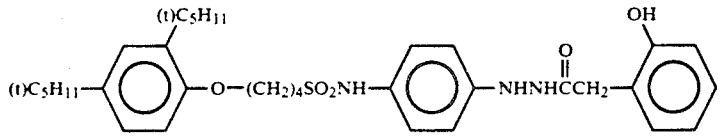
III-27)
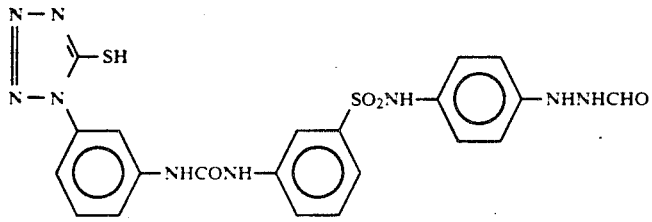
III-28)
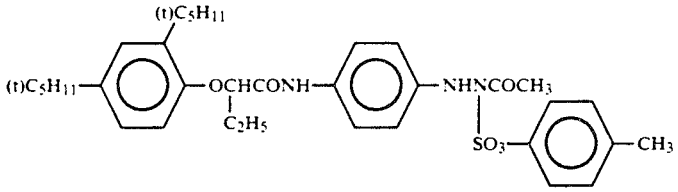
III-29)
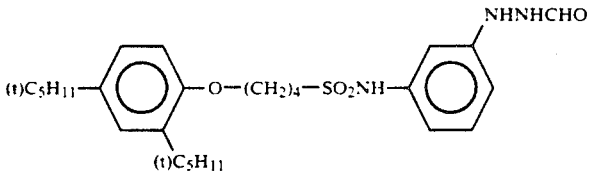
III-30)
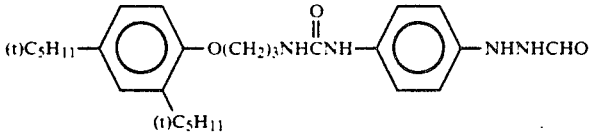
III-31)
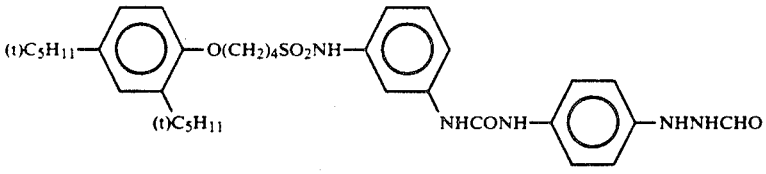
III-32)
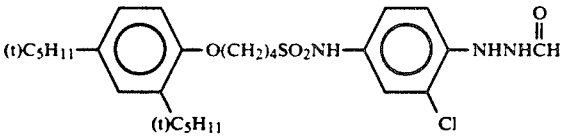
III-33)
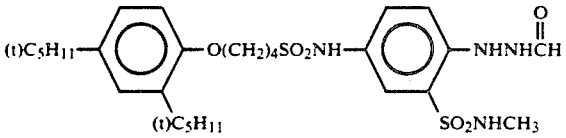

-continued
III-34)
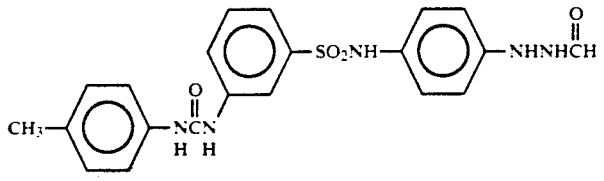
III-35)
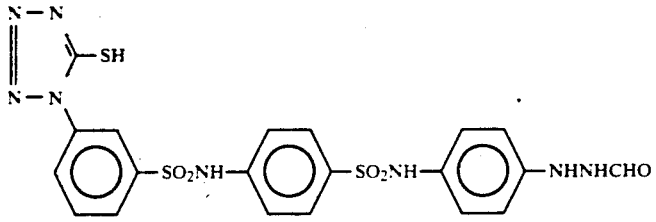
III-36)
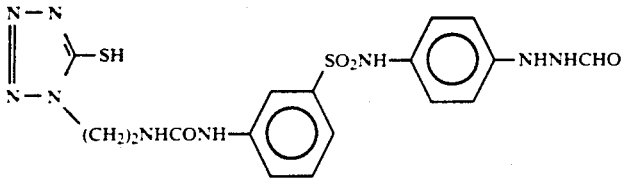
III-37)
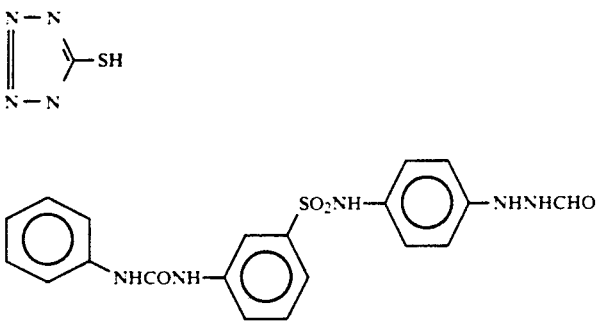
III-38)
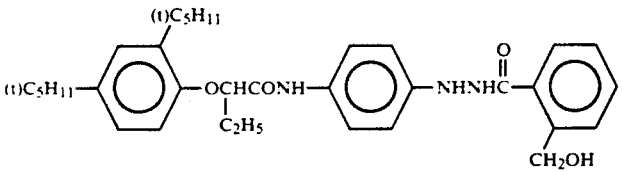
III-39)
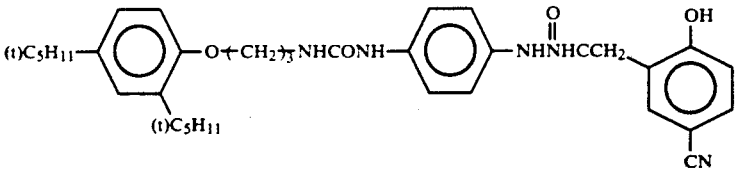
III-40)
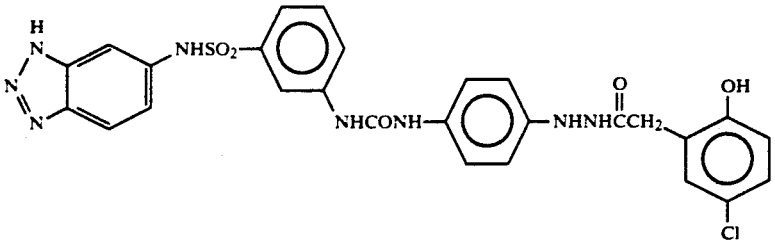

-continued
III-41)
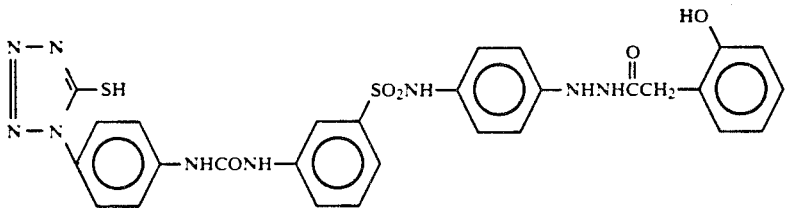
III-42)
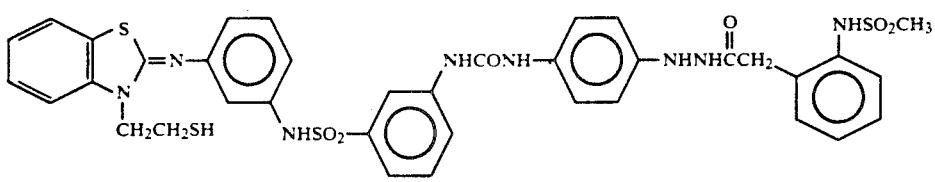
III-43)
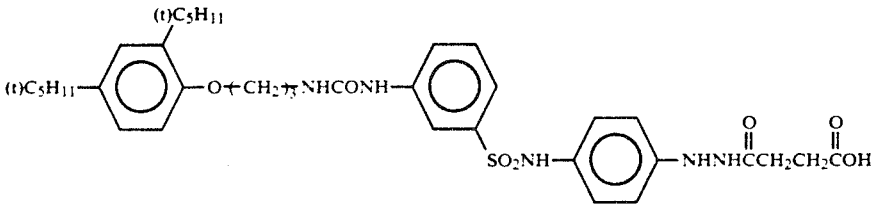
III-44)
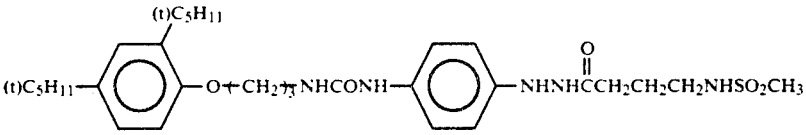
III-45)
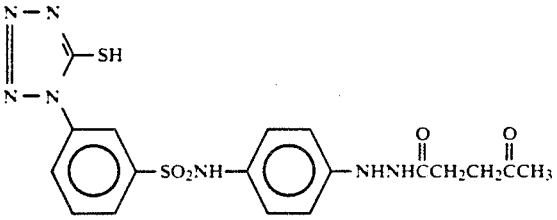
III-46)
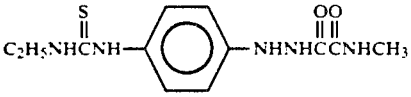
III-47)
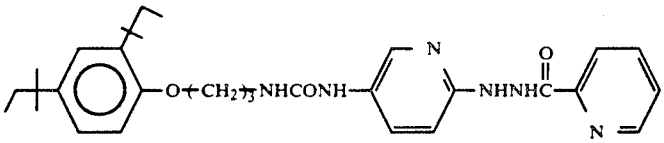
III-48)
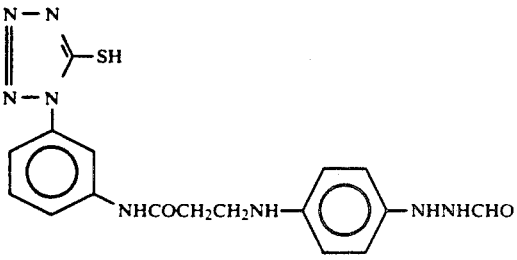

-continued
III-49)
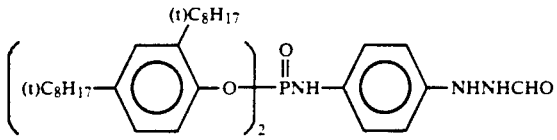
III-50)
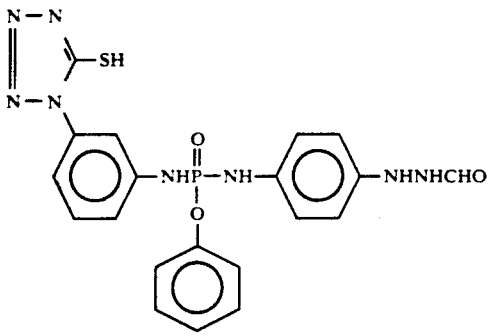
III-51)
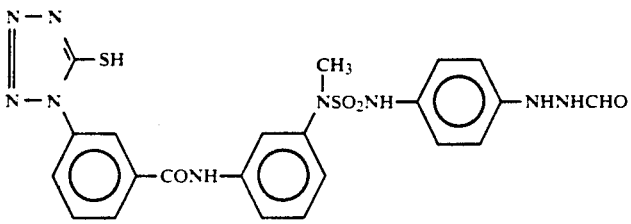
III-52)
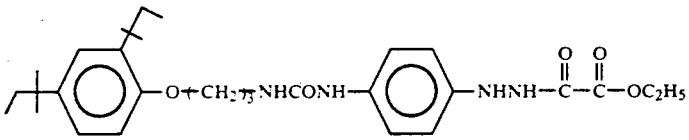
III-53)
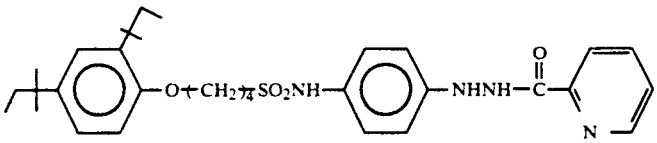
III-54)
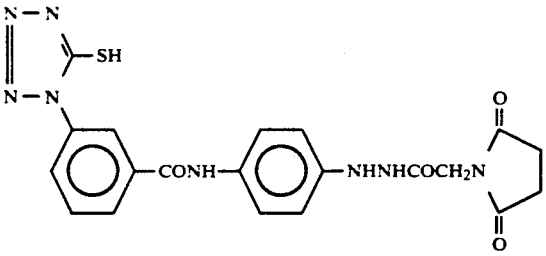
III-55)
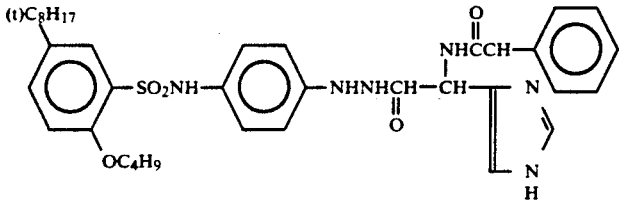

-continued

III-56)

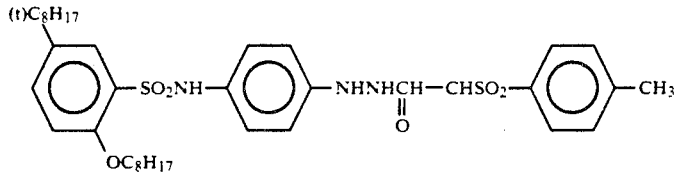

III-57)

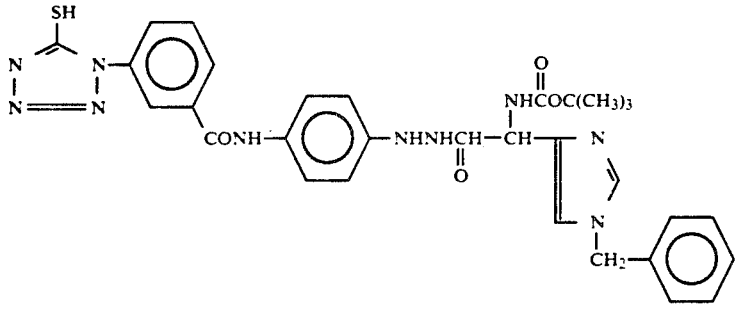

III-58)

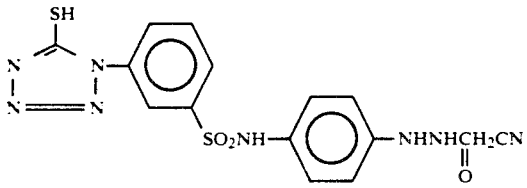

III-59)

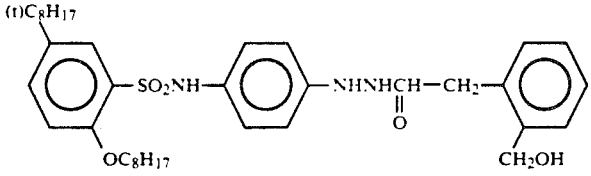

III-60)

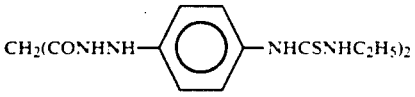

III-61)

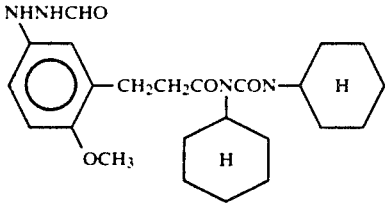

III-62)

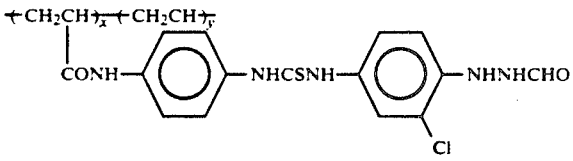

x:y = 97:3

The pyrazine derivatives used in this invention, in addition to those mentioned above include those in Research Disclosure No. 23516 (p. 346, November 1983) and in the literature cited therein, and also those described in U.S. Pat. Nos. 4,080,207, 4,269,929, 4,276,364, 4,278,748, 4,385,108, 4,459,347, 4,560,638, 4,478,928, G.B. Patent No. 2,011,391B, JP-A-60-179734, JP-A-62-270948, JP-A-63-29751, JP-A-61-170733, JP-A-61-270744, JP-A-62-948, EP 217,310U.S. Pat. No. 4,686,167, JP-A-62-178246, JP-A-63-32538, JP-A-63-104047, JP-A-63-121838, JP-A-63-129337,JP-A-63-223744,JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439,JP-A-1-276128, JP-A-1-283548, JP-A-1-280747, JP-A-1-283549, JP-A-1-285940, Japanese Patent Applications No. 63-147339, 63-179760, 63-229163, 1-18377, 1-18378, 1-18379, 1-15755, 1-16814, 1-40792, 1-42615, 1-42616, 1-123693 and 1-126284.

The addition amount for the hydrazine derivatives in this invention is preferably $1\times10^{-6}$ mole to $5\times10^{-2}$ mole, and particularly preferably within the range $1\times10^{-5}$ mole to $2\times10^{-2}$ mole with respect to 1 mole of silver halide.

More specifically, the compound used may be added to a hydrophilic colloid solution as an aqueous solution when it is water soluble, as a solution of an organic solvent which is miscible with water such as an alcohol, ether or ketone when it is sparingly soluble in water, or by inclusion in the fine polymer grains using the same method as the preparation method for the fine polymer grains containing the redox compound and melting-point-lowering agent of this invention. The addition to the silver halide emulsion layer may be undertaken at any desired time from the start of chemical ripening until before coating, but it is preferable to effect the addition from after the completion of chemical ripening until before coating. In particular, it may be added to the coating solution which has been prepared for the coating.

As regards the content of the hydrazine derivative of this invention, the optimum amount is selected in accordance with the grain size, halogen composition and the methods and processes in the chemical sensitization of the silver halide emulsion, the relationship between the layer containing the said compound and the silver halide emulsion layer, the type of antifogging compound and the like, and the methods for testing for this selection are well known to those in the industry. Normally, it is preferably used within a range of $10^{-6}$ mole to $1\times10^{1}$ mole, and particularly preferably of $10^{-5}$ to $4\times10^{-2}$ mole per mole of silver halide.

The silver halide emulsion used in this invention may be a combination of silver chloride, silver chlorobromide, silver iodobromide, silver iodochlorobromide and the like.

The average grain size of the silver halide used in this invention is preferably of a fine size (for example 0.7 μm or less) and particularly preferably 0.5 μm or less. Basically, there are no restrictions on the grain size distribution, but it is preferably monodisperse. "Monodisperse" as referred to here means that they are composed of groups of grains at least 95% of which, by weight or by grain number, have a size within ±40% of the average grain size.

The silver halide grains in the photographic emulsion may have a cubic, octahedral or other such regular crystal form, a spherical, tabular or other such irregular crystal form or may have complex forms of these crystal forms.

The silver halide grains may comprise a uniform phase or different phases between the inside and the surface. Two or more types of silver halide emulsion which have been formed separately may also be used as a mixture.

Cadmium salts, sulfites, lead salts, thallium salts, rhodium salts or complex salts thereof, iridium salts or complex salts thereof and the like may also be present during the silver halide grain formation or physical ripening stages for the silver halide emulsions used in this invention.

The emulsion layers or other hydrophilic colloid layers of this invention may contain water-soluble dyes as filter dyes, for irradiation prevention and for various other purposes. By way of filter dyes, use is made of dyes which further reduce the photographic speed, and preferably of ultraviolet absorbers which have a spectral absorption maximum in the intrinsic sensitivity region of the silver halide, and of dyes which have a practical light absorption mainly in the 350 nm–600 nm region to increase the stability in a safe-light when employed as a bright-room photosensitive material.

These dyes are preferably used when fixed as required either by addition to the emulsion layer or by addition, together with a mordant, above the silver halide emulsion layers, which is to say to a non-photosensitive hydrophilic colloid layer which is further from the support than the silver halide emulsion layers.

The dye is normally added within a range of $10^{-2}$ g/m$^2$ to 1 g/m$^2$, although this will vary according to the molecular extinction coefficient of the dye. Fifty mg to 500 mg/m$^2$ is preferred.

Specific examples of dyes are described in detail in JP-A-63-64039, but a few are given below.

D-1

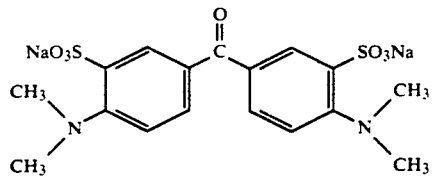

D-2

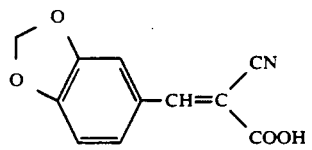

D-3

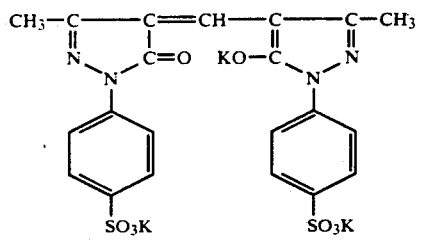

D-4

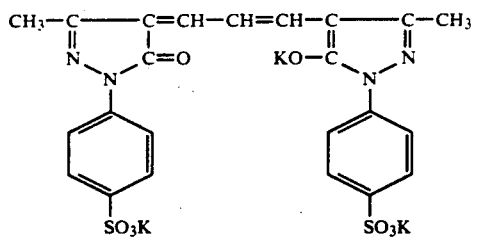

D-5

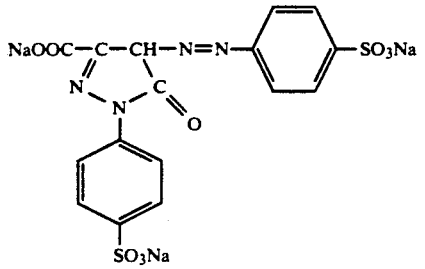

-continued

D-6

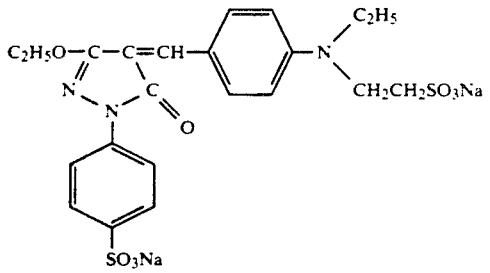

The above dyes are added to the coating solution for the non-photosensitive hydrophilic colloid layer of this invention having been dissolved in a suitable solvent such as water, an alcohol (for example methanol, ethanol or propanol), acetone or methyl Cellosolve, or a mixed solvent thereof.

Two or more of these dyes may be used in combination.

The dyes of this invention are used in the amount necessary to enable handling in a bright room.

The preferred amount of dye is generally within the range $10^{-3}$ g/m$^2$ to 1 g/m$^2$ and particularly preferably within the range $10^{-3}$ g/m$^2$ to 0.5 g/m$^2$.

It is advantageous to use gelatin as a binder or protective colloid for the photographic emulsions, but it is also possible to use other hydrophilic colloids. For example, it is possible to use various synthetic hydrophilic macromolecular substances such as gelatin derivatives, graft polymers of gelatin with other macromolecules, albumin, casein and other such proteins, hydroxyethylcellulose, carboxymethylcellulose, cellulose sulfate esters and other such cellulose derivatives, sodium alginate, starch derivatives and other such carbohydrate derivatives, polyvinyl alcohol, polyvinyl alcohol part acetal, poly-N-vinylpyrrolidone, polyacrylic acid, polymethacrylic acid, polyacrylamide, polyvinyl imidazole, polyvinyl pyrazole and the like either as homo- or copolymers.

In addition to lime-treated gelatin, acid-treated gelatin may also be used as the gelatin, and it is also possible to use gelatin hydrolysis products and gelatin enzymolysis products.

The silver halide emulsion used in the method of this invention need not be chemically sensitized but may be chemically sensitized. Sulfur sensitization, reduction sensitization and precious metal sensitization are known as methods of chemically sensitizing silver halide emulsions, and the chemical sensitization may be effected using any of these alone or in combination.

Gold sensitization is representative of precious metal sensitization and uses gold compounds, principally gold complex salts. Complex salts of precious metals other than gold such as platinum, palladium and iridium may also be included without detriment. Specific examples of these are described in, for example, U.S. Pat. No. 2,448,060 and G.B. Patent No. 618,061.

In addition to the sulfur compounds contained within the gelatin, various sulfur compounds such as thiosulfates, thioureas, thiazoles and rhodanines can be used as sulfur sensitizers.

Stanhous salts, amines, formamidinesulfinic acid, silane compounds and the like can be used as reduction sensitizers.

Known spectrally sensitizing dyes may be added to the silver halide emulsion layers used in this invention.

The photosensitive material of this invention can contain various compounds for the purposes of preventing fogging and stabilizing the photographic performance during the production, storage and photographic processing of the photosensitive material. Thus, it is possible to add many compounds which are known as antifoggants and stabilizers such as azoles like benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles and the like; mercaptopyrimidines; mercaptotriazines; thioketo compounds such as oxazolinethione; azaindenes like triazaindenes, tetraazaindenes (in particular 4-hydroxy-substituted (1,3,3a,7)tetraazaindenes), pentaazaindenes and the like; benzenethiosulfonic acid, benzenesulfinic acid and benzenesulfonic acid amide and the like. Of these, preference is given to benzotriazoles (for example 5-methylbenzotriazole) and nitroindazoles (for example 5-nitroindazole). Further, these compounds may be included in the processing solutions.

The photographic material of this invention may contain inorganic or organic film hardeners in the photographic emulsion layers or other hydrophilic colloid layers. For example, it is possible to use, either singly or in combination, chromium salts (for example chrome alum) aldehydes (for example glutaraldehyde), N-methylol compounds (for example dimethylolurea), dioxane derivatives, active vinyl compounds (for example 1,3,5-triacryloylhexahydro-s-triazine and 1,3-vinylsulfonyl-2-propanol), active halogen compounds (for example 2,4,-dichloro-6-hydroxy-s-triazine), mucohalic acids and the like.

The photographic emulsion layers and other hydrophilic colloid layers of the photosensitive materials produced using this invention can contain various surfactants for various purposes such as auxiliary coating, static prevention, improving slip properties, emulsification and dispersion, sticking prevention and improving the photographic properties (such as development acceleration, increased gradation, greater sensitivity).

By way of example, it is possible to use nonionic surfactants such as saponin (steroid-type), alkylene oxide derivatives (for example polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, or polyethylene oxide adducts of silicones), glycidol derivatives (for example alkenyl succinate polyglyceride and alkylphenol polyglyceride), fatty acid esters of polyhydric alcohols and alkyl esters of sugars; anionic surfactants which contain acidic groups such as the carboxyl group, sulfo group, phospho group, sulfuric acid ester group or phosphoric acid ester group such as alkyl carboxylates, alkyl sulfonates, alkylbenzenesulfonates, alkylnaphthalenesulfonates, alkyl sulfate esters, alkyl phosphate esters, N-acyl-N-alkyl taurines, sulfosuccinic acid esters, sulfoalkylpolyoxyethylene alkylphenyl ethers, polyoxyethylene alkylphosphate esters; amphoteric surfactants such as amino acids, aminoalkyl sulfonates, aminoalkyl sulfuric acid or phosphoric acid esters, alkylbetanes and amine oxides; and cationic surfactants such as alkylamine salts, aliphatic or aromatic quaternary ammonium salts, pyridinium, imidazolium and other such heterocyclic quaternary ammonium salts and phosphonium or sulfonium salts containing aliphatic or heterocyclic rings.

The polyalkylene oxides with molecular weights of 600 or more which are described in JP-B-58-9412 are particularly preferred as the surfactants used in this invention. Further, a polymer latex such as a polyalkyl acrylate can be included for dimensional stability.

Development accelerators or nucleation infectious development accelerators appropriate for use in this invention include various compounds containing a nitrogen or sulfur atom are effective, as are the compounds disclosed in, for example, JP-A-53-77616, JP-A-54-37732, JP-A-53-137133, JP-A-60-140340 and JP-A-60-14959.

Specific examples are given below.

1

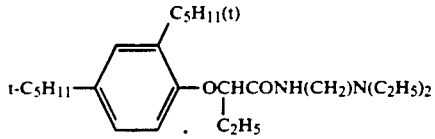

2

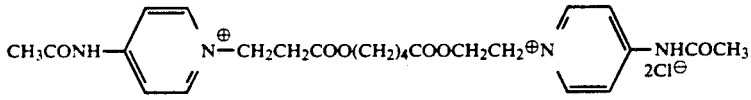

3

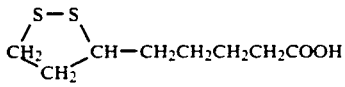

4

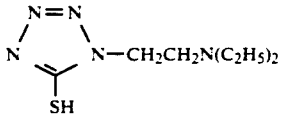

5

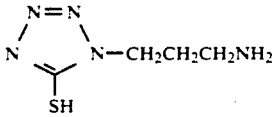

6

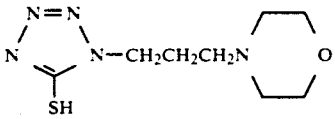

7

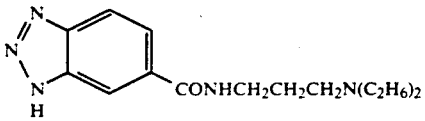

8

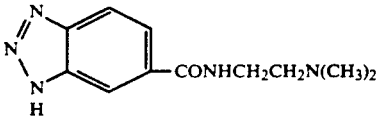

9

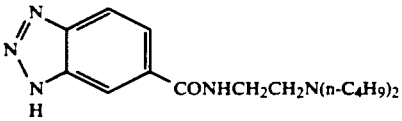

10

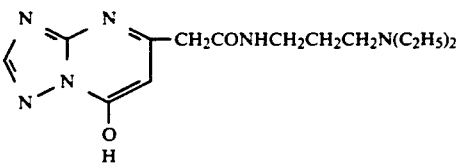

-continued

11

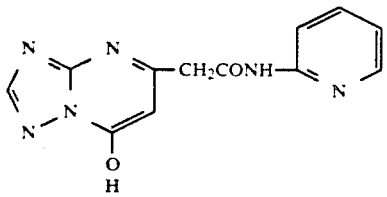

12

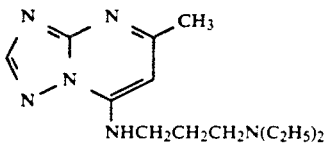

13

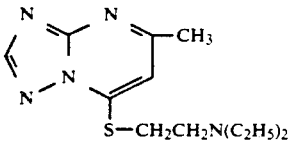

14

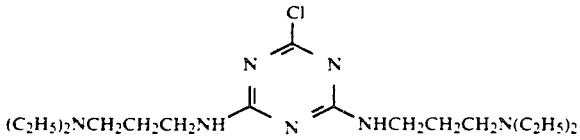

15

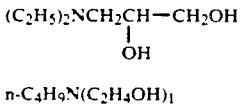

The optimum addition amount for these accelerators will vary in accordance with the type of compound but it is desirable to use them in a range of $1.0\times10^{-3}$ to 0.5 g/m$^2$ and preferably of $5.0\times10^{31\ 3}$ to 0.1 g/m$^2$. These accelerators are added to the coating solution having been dissolved in a suitable solvent (for example $H_2O$, an alcohol such as methanol or ethanol, acetone, dimethylformamide or methyl Cellosolve).

Two or more of the additives may be used conjointly.

It is not necessary to use a conventional infectious development solution or the high-alkali development solution with a pH of close to 13 as disclosed in U.S. Pat. No. 2,419,975 in order to achieve an ultra-high contrast when using the silver halide material of this invention, and it is possible to use a stable developing solution.

Thus, with the silver halide photosensitive material of this invention, it is possible to obtain an adequately ultra-high contrast negative image using a developing solution with a pH of 10.5 to 12.3, or more particularly a pH of 11.0 to 12.0, and containing 0.15 mole/l or more of sulfite ions as a preservative.

There are no particular limitations on the developing agents which can be used in the method of this invention, and it is possible to use, either singly or in combination, dihydroxybenzenes (for example hydroquinone), 3-pyrazolidones (for example, 1-phenyl-3-pyrazolidone, 4,4-dimethyl-1-phenyl-3-pyrazolidone), aminophenols (for example N-methyl-p-aminophenol) and the like.

The silver halide photosensitive material of this invention is appropriately processed in a developing solution containing a dihydroxybenzene as the principal developing agent and a 3-pyrazolidone or an aminophenol as an auxiliary developing agent. For preference, a dihydroxybenzene and a 3-pyrazolidone or aminophenol are conjointly used within a range of 0.05 to 0.5 mole/l and 0.06 mole/l or less respectively in this developing solution.

Further, it is possible to increase the developing rate and shorten the developing time by adding an amine to the developing solution as has been described in U.S. Pat. No. 4,269,929.

In addition, the developing solution can contain pH buffers such as an alkali metal sulfite, carbonate, borate or phosphate, and antifoggants and development inhibitors such as an organic antifoggant (particularly preferably a nitro indazole or benzotriazole) and bromine compounds and iodine compounds. Further, water softeners, auxiliary solvents, toners, development accelerators, surfactants (particularly preferably the polyalkylene oxides mentioned above), defoaming agents, film hardeners and agents for preventing silver staining in the film (for example 2-mercaptobenzimidazole sulfonates and the like) may also be included as necessary.

Fixing solutions with commonly used compositions can be used as the fixing solution. Additionally thiosulfates and thiocyanates, organic sulfur compounds with a known fixing effect can be used as fixing agents. Water-soluble aluminum salts may be included in the fixing solution as film hardeners.

The processing temperature for the method of this invention can usually be chosen from between 18° C. to 50° C.

It is preferable to use an automatic developing apparatus for the photographic processing, and the method of this invention makes it possible to obtain the photographic characteristic of an adequate ultra-high contrast negative gradation even when the total processing time from when the photosensitive material is inserted into the automatic developing apparatus until it emerges has been set at 90 seconds to 120 seconds.

The compound described in JP-A-56-24347 can be used as an agent for preventing silver staining in the developing solution of this invention. The compound described in JP-A-61-267759 can be used as an auxiliary solvent which is added to the developing solution. Moreover, the compound described in JP-A-60-93433 or the compound described in Japanese Patent Application 61-28708 can be used as the pH buffer which is employed in the developing solution.

The invention is described in detail by means of examples below, which are not to be construed as limiting the scope thereof. Unless otherwise indicated, all parts, percents and ratios are by weight.

EXAMPLE 1

Preparation Method for Polymer Grains Containing a Redox Compound and a Melting-Point-Lowering Agent A solution consisting of 3.0 g of the redox compound (29), 3.0 g of the following melting-point-lowering agent (II-6), 6.0 g of the illustrative polymer compound P-57 and 50 ml of ethyl acetate was heated to 60° C. and then added to 120 ml of an aqueous solution containing 12 g of gelatin and 0.7 g of sodium dodecylbenzenesulfonate and a high-speed stirrer (a homogenizer, Nihon Seiki Seisaku-sho) was used to obtain a fine-grained emulsion medium. This emulsion medium was subjected to distillation by heating under reduced pressure to remove the ethyl acetate. This was designated Emulsion Medium (A).

Emulsions (B) to (D) were prepared in the same way as the above Emulsion Medium except that the redox compound and/or the melting-point-lowering agent in the above emulsion medium were altered.

Emulsion Medium (B)

The redox compound (29) was changed to redox compound (38).

Emulsion Medium (C)

The redox compound (29) was changed to redox compound (51).

Emulsion Medium (D)

This was prepared in the same way as Emulsion Medium (C) except that the melting-point-lowering agent (II-6) in Emulsion Medium (C) was changed to melting-point-lowering agent (II-12).

Emulsion medium 1 (Comparative Emulsion Medium)

Emulsion Medium 1 was prepared in the same way as Emulsion Medium (A) except that the melting-point-lowering agent was removed from Emulsion Medium (A).

Preparation of a Photosensitive Emulsion

A monodisperse cubic emulsion with an average grain size of 0.28 μm and an average silver iodide content of 0.3 mol. % was prepared by simultaneously adding, over 60 minutes, an aqueous silver nitrate solution and an aqueous solution of potassium iodide and potassium bromide to an aqueous gelatin solution held at 50° C. in the presence of ammonia and potassium hexachloroiridate(III) in an amount of $4\times10^{-7}$ mole per mole of silver. This emulsion was desalted by flocculation, then 40 g of inert gelatin was added for every mole of silver, following which it was held at 50° C. and added to a $10^{-3}$ mol/l mol Ag KI solution with 5,5'-dichloro-9-ethyl-3,3'-bis(3-sulfopropyl)oxacarbocyanine as a perservative, this was left for 15 minutes and then the temperature was reduced.

Preparation of Coating Samples

Support: a polyethylene terephthalate film (150 μm) with an undercoating layer (0.5 μm) consisting of a vinylidene chloride copolymer.

This support underwent coating in such as way as to constitute the layers UL, ML, OL and PC in sequence from the support. The preparation methods and coated amounts of each of the layers are given below.

UL

The above emulsion was dissolved together with gelatin at 40° C., the above emulsion medium (A) was then added and dissolved followed by the further addition of 5-methyl-benzotriazole, 4-hydroxy-1,3,3a,7-tetraazaindene, the following compounds (i), (ii) and (iii), 30% by weight of poly(ethyl acrylate) with respect to the gelatin and of the following compound (iv) as a gelatin hardener, and this was coated to 0.4 g/m² of silver, $6.4\times10^{-5}$ mol/m² of redox compound and 0.5 g/m² of gelatin.

Compound (i)

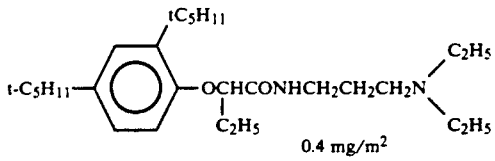

0.4 mg/m²

Compound (ii)

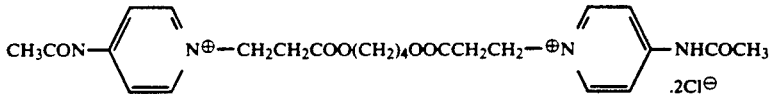

1.5 mg/m²

Compound (iii)

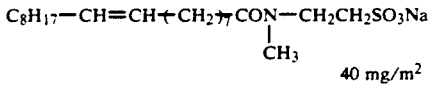

40 mg/m²

-continued

Compound (iv)

$$CH_2{=}CHSO_2CH_2\underset{\displaystyle OH}{\underset{|}{C}}HCH_2SO_2CH{=}CH_2$$

2.0% by weight with respect to gelatin

ML

An aqueous solution containing 10 g of gelatin and 30 mg/m$^2$ of the above compound (A) was prepared in an overall amount of 250 ml, and coated to a gelatin amount of 1.5 g/m$^2$.

OL

The above emulsion was redissolved and the hydrazine derivatives shown in Table 1 were added at 40° C. and this was followed by the further addition of 5-methylbenzotriazole, 4-hydroxy-1,3,3a,7-tetraazaindene, 1.0 mg/m$^2$ of compound (i), 6.0 mg/m$^2$ of (ii) and 42 mg/m$^2$ of (iii), 30% by weight of poly(ethyl acrylate) with respect to the gelatin and of compound (iv) as a gelatin hardener (4% by weight with respect to the gelatin). This was coated to 3.4 g/m$^2$ of silver.

PC

A poly(methyl methacrylate) dispersion (average particle size 2.5 μm) and the following surfactant were added to a gelatin solution which was coated to 0.5 g/m$^2$ of gelatin and to 0.15 g/m$^2$ of poly(methyl methacrylate).

| Surfactants | | |
|---|---|---|
| 1 | 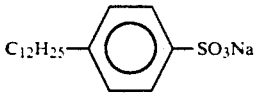 | 37 mg/m$^2$ |
| 2 | $CH_2COOC_6H_{13}$<br>\|<br>$CHCOOC_6H_{13}$<br>\|<br>$SO_3Na$ | 37 mg/m$^2$ |
| 3 | $C_8F_{17}SO_2\underset{\displaystyle C_3H_7}{\underset{\vert}{N}}CH_2COOK$ | 2.5 mg/m$^2$ |

COMPARATIVE EXAMPLE 1

The same procedure as that in Example 1 was undertaken except that the redox compound (51) was added as a 1.0% by weight methanol solution instead of the Emulsion Medium (A) of UL in Example 1.

COMPARATIVE EXAMPLE 2

The same procedure as that in Example 1 was carried out except that Emulsion Medium (A) in Example 1 was replaced by Emulsion Medium 1 (comparative emulsion medium).

EXAMPLE 2

The same procedure as that in Example 1 was carried out except that Emulsion Medium (A) of UL in Example 1 was replaced by Emulsion Media (B), (C) and (D) respectively and the hydrazine derivatives of OL were altered as shown in Table 1.

EXAMPLE 3

The same procedure as that in Example 1 was carried out except that a solution in which 1 g of the redox compound (51) and 1 g of the melting-point-lowering agent (II-12) had been dissolved in 200 cc of methanol was added instead of the Emulsion Medium (A) of UL in Example 1 (the addition amounts for the redox compound are given in Table 1).

Preparations in which the various UL solutions prepared as described above had been freshly prepared (within 60 minutes), and in which they had been aged for 12 hours at 40° C. were coated onto supports. Coating was carried out using freshly prepared (within 60 minutes) ML, OL and PC solutions.

| Developing solution | |
|---|---|
| Hydroquinone | 50.0 g |
| N-Methyl-p-aminophenol | 0.3 g |
| Sodium hydroxide | 18.0 g |
| 5-Sulfosalicylate | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonate | 0.3 g |
| Sodium 3-(5-mercaptotetrazole)benzene sulfonate | 0.2 g |
| N-n-Butyldiethanolamine | 15.0 g |
| Sodium toluenesulfonate | 8.0 g |
| Water to make | 1 l |
| Adjusted to pH = 11.6 (by adding potassium hydroxide) | |

Evaluation of Performance

These samples were exposed through an optical wedge and a contact screen (Fuji Film, Model 150 L chain dot) under a tungsten light at 3,200° K., following which they were developed in the above developing solution for 30 seconds at 34° C., fixed, washed and dried.

The results obtained from measurements of the halftone quality and halftone gradation of the resulting samples are given in Table 1. The halftone gradation is expressed by the definition as set forth below.

$\overline{G}$: The gradient of the straight line connecting the point 0.3 with the point 3.0 for the density on the characteristic curve. The larger the value the higher the contrast.

Haftone Gradation ($\Delta$log E)=(log E 95%)−(log E 5%) wherein (log E 5%) is the exposure which provides a halftone area percentage of 5% subtracted and (log E 95%) is the exposure which provides a halftone area percentage of 95%.

The halftone quality was evaluated visually in 5 grades. In the 5-grade evaluation, "5" denotes the best and "1" the worst quality. With respect to halftone plates for platemaking "5" and "4" are acceptable qualities for practical use, "3" is of a borderline quality level acceptable for practical use, and "2" and "1" are of a quality unacceptable for practical use.

The results are given in Table 1.

It will be seen that, with the samples of this invention, $\overline{G}$ is high and there is a very high contrast and there is a good halftone quality with a very wide halftone gradation. Further, it will be seen that the samples are outstanding in that there is very little deterioration in the image quality even when the coating solution for the layer to which the redox compound has been added is aged for a long time.

On the other hand, the samples in which the redox compound had been added to the methanol solution by itself had a low $\overline{G}$ even when coated freshly after preparation, and the quality further deteriorated upon ageing of the coating solution. Further, the samples which employed a redox compound dispersed in a polymer without also using a melting-point-lowering agent did have a good performance when coated freshly after preparation, but $\overline{G}$ reduced and the image quality was seen to deteriorate upon ageing of the coating solution.

It will be seen that a stable and good image quality is obtained according to this invention.

melting-point-lowering agent (II-12) were added to OL as shown in Table 2 and the hydrazine derivatives were altered as shown in Table 2.

COMPARATIVE EXAMPLE 3

This was prepared in the same way as Example 4 except that the abovementioned Emulsion Medium 1 and the methanol solution of the redox compound (51) was added to OL in Example 4.

The coating was applied by preparations in which the OL solution prepared as described above had been freshly prepared and in which it had been aged for 12 hours at 40° C. Coating was carried out using a preparation in which the PC solution had been freshly prepared.

TABLE 1

| Sample Designation | | UL Redox compound | OL Hydrazine derivative Type | OL Hydrazine derivative Amount added* | Photographic properties (Fresh) G | Photographic properties (Fresh) Halfone gradation | Photographic properties (Fresh) Dot Quality | Photographic properties (after ageing UL for 12 hours) G | Photographic properties (after ageing UL for 12 hours) Halftone gradation | Photographic properties (after ageing UL for 12 hours) Dot quality | Comment |
|---|---|---|---|---|---|---|---|---|---|---|---|
| Example | 1-1 | Emulsion medium (A) | III-5 | $2.3 \times 10^{-3}$ | 12.4 | 1.41 | 5 | 11.8 | 1.36 | 5 | This invention |
| | 1-2 | " | III-19 | $1.3 \times 10^{-4}$ | 1.27 | 1.43 | 5 | 12.3 | 1.38 | 5 | This invention |
| | 1-3 | " | III-30 | $7.8 \times 10^{-4}$ | 13.2 | 1.44 | 5 | 12.5 | 1.39 | 5 | This invention |
| | 1-4 | " | III-41 | $1.6 \times 10^{-4}$ | 13.0 | 1.44 | 5 | 12.5 | 1.40 | 5 | This invention |
| Comp. Ex. | 1-1 | Redox compound (29) added to a methanol solution | III-5 | $2.3 \times 10^{-3}$ | 10.3 | 1.26 | 4 | 8.3 | 1.21 | 3 | Comparative example |
| | 1-2 | Redox compound (29) added to a methanol solution | III-19 | $1.3 \times 10^{-4}$ | 10.5 | 1.26 | 4 | 8.2 | 1.20 | 3 | Comparative example |
| Comp. Ex. | 2-1 | Comp. emulsion med. 1 | III-5 | $2.3 \times 10^{-3}$ | 12.5 | 1.41 | 5 | 10.4 | 1.25 | 4 | Comparative example |
| | 2-2 | " | III-19 | $1.3 \times 10^{-4}$ | 12.7 | 1.42 | 5 | 10.4 | 1.26 | 4 | Comparative example |
| Example | 2-1 | Emulsion medium (B) | III-5 | $2.3 \times 10^{-3}$ | 12.8 | 1.45 | 5 | 12.2 | 1.37 | 5 | This invention |
| | 2-2 | " | III-19 | $1.3 \times 10^{-4}$ | 12.4 | 1.43 | 5 | 12.0 | 1.39 | 5 | This invention |
| | 2-3 | Emulsion medium (C) | III-5 | $2.3 \times 10^{-3}$ | 12.5 | 1.43 | 5 | 11.7 | 1.36 | 5 | This invention |
| | 2-4 | " | III-19 | $1.3 \times 10^{-4}$ | 12.6 | 1.42 | 5 | 11.9 | 1.37 | 5 | This invention |
| | 2-5 | Emulsion medium (D) | III-5 | $2.3 \times 10^{-3}$ | 12.5 | 1.43 | 5 | 12.1 | 1.38 | 5 | This invention |
| | 2-6 | " | III-19 | $1.3 \times 10^{-4}$ | 12.5 | 1.42 | 5 | 12.2 | 1.38 | 5 | This invention |
| | 2-7 | " | III-30 | $7.8 \times 10^{-4}$ | 12.9 | 1.45 | 5 | 12.4 | 1.39 | 5 | This invention |
| | 2-8 | " | III-41 | $1.6 \times 10^{-4}$ | 13.0 | 1.45 | 5 | 12.4 | 1.40 | 5 | This invention |
| Example | 3 | Redox compound (51) and melting-point-lowering agent added as a methanol solution | III-19 | $1.3 \times 10^{-4}$ | 12.6 | 1.43 | 5 | 11.5 | 1.32 | 5 | This invention |

(*mole/mole of silver)
Comp. Ex. = comparative example

EXAMPLE 4

Support: a polyethylene teraphthalate film (100 μm) having an undercoating layer (0.5 μm) consisting of a vinylidene chloride copolymer.

Coating was carried out in a layer structure of OL, PC from the support side onto the support. Each layer of OL and PC was prepared and coated with the same method as Example 1. The preparation was undertaken in the same way as for OL in Example 1 except that the abovementioned Emulsion Media (A) to (D) and a methanol solution of the redox compound (51) and The exposure, development processing and evaluation of performance were undertaken in the same way as in the method described above.

The results of the examples are given in Table 2.

The samples of this invention had a very high contrast, a wide halftone gradation and a good halftone quality. Further, it will be seen that there was very little deterioration of the image quality and that a stable photographic performance was obtained even after the coating solution had been aged.

TABLE 2

| Sample Designation | | UL Redox compound | OL Hydrazine derivative Type | OL Hydrazine derivative Amount added* | Photographic properties (Fresh) G | Photographic properties (Fresh) Halfone gradation | Photographic properties (Fresh) Dot Quality | Photographic properties (after ageing UL for 12 hours) G | Photographic properties (after ageing UL for 12 hours) Halftone gradation | Photographic properties (after ageing UL for 12 hours) Dot quality | Comment |
|---|---|---|---|---|---|---|---|---|---|---|---|
| Example | 4-1 | Emulsion medium (A) | III-19 | $1.3 \times 10^{-4}$ | 12.8 | 1.40 | 5 | 12.1 | 1.42 | 5 | This invention |
| | 4-2 | Emulsion medium (B) | " | " | 12.7 | 1.41 | 5 | 12.1 | 1.40 | 5 | This invention |
| | 4-3 | Emulsion medium (C) | " | " | 12.5 | 1.40 | 5 | 12.3 | 1.38 | 5 | This invention |
| | 4-4 | Emulsion medium (D) | III-5 | $2.3 \times 10^{-3}$ | 12.4 | 1.43 | 5 | 12.0 | 1.42 | 5 | This invention |
| | 4-5 | " | III-19 | $1.3 \times 10^{-4}$ | 12.8 | 1.42 | 5 | 12.3 | 1.43 | 5 | This invention |
| | 4-6 | " | III-41 | $1.6 \times 10^{-4}$ | 12.3 | 1.40 | 5 | 11.8 | 1.40 | 5 | This invention |
| | 4-1 | Redox compound (51) and melting-point-lowering agent (II-12) (added as a methanol solution) | III-5 | $2.3 \times 10^{-3}$ | 12.1 | 1.38 | 5 | 11.2 | 1.34 | 5 | This invention |
| | 4-2 | Redox compound (51) and melting-point-lowering agent (II-12) (added as a methanol solution) | III-19 | $1.3 \times 10^{-4}$ | 12.3 | 1.40 | 5 | 11.5 | 1.36 | 5 | This invention |
| Comparative Example | 3-1 | Emulsion medium 1 | III-19 | " | 12.5 | 1.40 | 5 | 10.7 | 1.30 | 4 | Comparative example |
| | 3-2 | Redox compound (51) (added as a methanol solution) | III-19 | " | 10.2 | 1.31 | 4 | 9.5 | 1.24 | 3 | Comparative example |

*$2.5 \times 10^{-5}$ mole/m$^2$ as the redox compound
(**mole/mole of silver)

EXAMPLE 5

Preparation of a Photosensitive Emulsion

An aqueous silver nitrate solution and an aqueous sodium chloride solution were simultaneously mixed in an aqueous gelatin solution held at 50° C. in the presence of $(NH_4)_3RHCl_6$ in an amount of $5.0 \times 10^{-6}$ mole per mole of silver, after which, using a method well known to those in the industry, the soluble salts were removed and then gelatin added followed by the addition of 2-methyl-4-hydroxy-1,3,3a,7-tetraazaindene as a stabilizer without chemical ripening. This emulsion was a monodisperse emulsion of cubic crystal form with an average grain size of 0.15 μm. (Emulsion A)

Preparation of Coated Samples

Support: A polyethylene terephthalate film (150 μm) having an undercoating layer (0.5 μm) consisting of a vinylidene chloride copolymer.

This support underwent coating in such a way as to comprise a layer structure of UL, ML, OL and PC from the support. The preparation methods and coated amounts for each layer are given below.

UL

The redox compound and melting-point-lowering agent of this invention were added to the above Emulsion A as shown in Table 3, followed by the further addition of the following compounds (a), (b), (c) and (d), 30% by weight of poly(ethyl acetate) with respect to the gelatin, and of 1,3-vinylsulfonyl-2-propanol as a film hardener, and this was coated to 0.4 g/m$^2$ of silver, 0.5 g/m$^2$ of gelatin and $6.4 \times 10^{-5}$ mol/m$^2$ of redox compound.

Compound (a) 0.5 mg/m$^2$

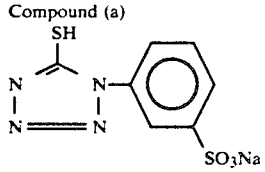

Compound (b) 2.7 mg/m$^2$

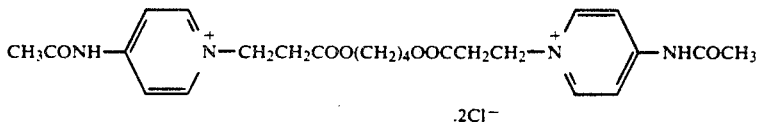

Compound (c)

-continued

| | |
|---|---|
| 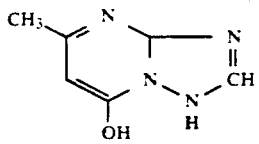 | 3.4 mg/m² |
| Compound (d) $C_8H_{17}-CH=CH+CH_2\rightarrow_7 CON(CH_3)-CH_2CH_2SO_3Na$ | 28 mg/m² |

ML

An aqueous solution containing 10 g of gelatin and 30 mg/m² of the abovementioned compound (D) was prepared to an overall amount of 250 ml and coated to 1.0 g/m² of gelatin.

OL

The abovementioned Emulsion (A) was redissolved, fine polymer particles containing a hydrazine derivative were added with the further addition of the abovementioned compounds (a) to (d), 30% by weight of poly(ethyl acrylate) with respect to the gelatin and 1,3-vinylsulfonyl-2-propanol (2% by weight with respect to the gelatin) as a film hardener to make a preparation which was coated to 3.8 g/m² of silver, 2 g/m² of gelatin and $7.5\times10^{-5}$ mol/m² of the following hydrazine derivative:

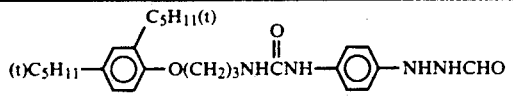

| Coated amounts of compounds (a) to (d) | |
|---|---|
| Compound (a) | 4.6 mg/m² |
| Compound (b) | 26 mg/m² |
| Compound (c) | 32.5 mg/m² |
| Compound (d) | 46 mg/m² |

PC

Polymethyl methacrylate particles (average particle size 2.5 μm) were added to the gelatin solution as a matting agent and the following surfactants, as auxiliary coating agents, stabilizers and ultraviolet absorbers were also added to make a preparation which was coated to 1.5 g/m² of gelatin and 0.3 g/m² of matting agent.

| | | |
|---|---|---|
| Surfactants: | | |
| 1 | 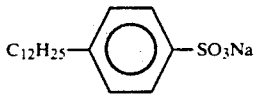 | 37 mg/m² |
| 2 | $CH_2COOC_6H_{13}$ / $CHCOOC_6H_{13}$ / $SO_3Na$ | 37 mg/m² |
| 3 | $C_8F_{17}SO_2N(C_3H_7)CH_2COOK$ | 2.5 mg/m² |
| Stabilizers: | | |
| | Thioctic acid | 2.5 mg/m² |
| | 1-Phenyl-5-mercaptotetrazole | 5.0 mg/m² |
| Ultraviolet absorber: | 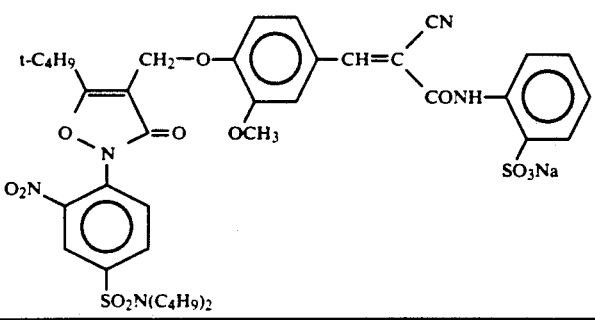 | 100 mg/m² |

Preparation of Fine Polymer Particles Containing a Hydrazine Derivative

A solution consisting of 1.5 g and 3.0 g of the hydrazine derivatives I-5 and I-30 respectively, 1.7 g of the melting-point-lowering agent II-6, 6.0 g of the polymer P-57 and 50 ml of ethyl acetate was heated to 60° C., and then added to 120 ml of an aqueous solution containing 12 g of gelatin, 0.7 g of sodium dodecylbenzenesulfonate and 20 mg of Proxel, and a high speed mixer (homogenizer, made by the Nihon Seiki Seisaku-sho) was used to obtain a fine-grained emulsion medium. This emulsion medium was subjected to distillation by heating under reduced pressure to remove the ethyl acetate. The average particle size of the emulsion was 0.11 μm. (Measuring using the Nanosizer).

COMPARATIVE EXAMPLE 4

Preparation and coating were carried out in the same way as in Example 5 except that the melting-point-lowering agent was removed from UL in Example 5 (as shown in Table 3).

Preparations in which the UL solutions prepared as described above had been freshly prepared (within 60 minutes), and in which they had been aged for 24 hours at 40° C. were coated onto supports. ML, OL and PC were coated using the preparations which had been freshly prepared.

As is clear from the results in Table 3, it will be seen that the samples of this invention are outstanding and maintain a good extracted character image quality from fresh until after they have been aged.

From the above results, it will be seen that by oxidizing in accordance with this invention, it is possible to provide photosensitive materials for platemaking which have an outstanding photographic performance, by having a redox compound which is able to release a development inhibitor present in a coating solution, in a stable manner, such that it is able to fulfill its intended use adequately.

This sample was subjected to an imagewise exposure via an original as shown in FIG. 1, using the brightroom printer P-607 made by the Dainippon Screen Co., Ltd., subjected to development processing for 20 seconds at 38° C. and to fixing, washing and drying, and then the extracted character image quality was evaluated.

An extracted character image quality of 5 is an extremely good extracted character image quality and refers to an image quality wherein characters with a width of 30 μm are reproduced when making an appropriate exposure using an original such as that in FIG. 1 such that 50% of the halftone area constitutes 50% of the halftone area on a photosensitive material for reversal. On the other hand, an extracted character image quality of 1 is a poor extracted character quality and refers to an image quality wherein it is not possible to reproduce characters with a width of 150 μm or more when making a similar appropriate exposure. Classes of from 4 to 2 were established between 5 and 1 by empirical evaluation. Three or more is a level suitable for practical use.

The results are given in Table 3. The samples of this invention have an outstanding extracted character image quality.

TABLE 3

| Sample designation | | Redox compound Type | Amount added* | Extracted image quality Fresh | After Ul ageing | Comment |
|---|---|---|---|---|---|---|
| Example | 5-1 | Emulsion medium (A) | $6 \times 10^{-5}$ | 4.5 | 4.0 | This invenion |
| | 5-2 | Emulsion medium (B) | " | 4.5 | 4.0 | " |
| | 5-3 | Emulsion medium (B) | " | 5.0 | 4.5 | " |
| | 5-4 | Redox compound (51) and melting-point-lowering agent (II-12) (added as a methanol solution) | " | 4.5 | 3.5 | " |
| Comparative Example | 4-1 | Comparative Emulsion 1 | " | 4.5 | 2.5 | Comparative example |
| | 4-2 | Redox compound (51) (methanol solution) | " | 3.5 | 2.5 | Comparative example |

While the invention has been described in detail and with reference to specific embodiments thereof, it will be apparent to one skilled in the art that various changes and modifications can be made therein without departing from the spirit and scope thereof.

What is claimed is:

1. A silver halide photographic material which has at least one photosensitive silver halide emulsion layer containing a hydrazine derivative, and in which said emulsion layer and/or a hydrophilic colloid layer which is different from said emulsion layer contains (i) a redox compound which releases a development inhibitor when it is oxidized and (ii) an organic compound which is a melting-point-lowering agent which is essentially insoluble in water and which has the effect of lowering the melting point of said redox compound when the former has been mixed with the latter, wherein the at least one redox compound and the at least one melting-point-lowering agent are contained in fine polymer particles.

2. A silver halide photographic material as claimed in claim 1, wherein the redox compound is represented by the following general formula (I):

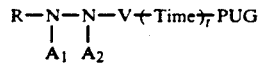

General formula (I)

wherein, $A_1$ and $A_2$ both represent hydrogen atoms or one is a hydrogen atom and the other represents a sulfinic acid residual group or

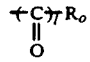

wherein $R_0$ represents an alkyl group, alkenyl group, aryl group, alkoxy group or aryloxy group, and l represent 1 or 2; Time represents a divalent linking group, t represents 0 or 1; PUG represents a development inhibitor, V represents a carbonyl group, $$-\underset{\underset{O}{\|}}{C}-\underset{\underset{O}{\|}}{C}-.$$

sulfonyl group, sulfoxy group, $$-\overset{\overset{O}{\|}}{\underset{\underset{R_1}{|}}{P}}-$$

($R_1$ representing an alkoxy group or aryloxy group), an iminomethylene group or a thiocarbonyl group, and R represents an aliphatic group, aromatic group or heterocyclic group.

3. A silver halide photographic material as claimed in claim 1, wherein the melting-point-lowering agent is represented either the following general formulae (II) or (II'):

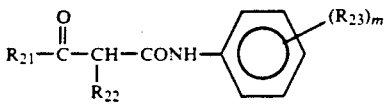

(II)

wherein $R_{21}$ represents a substituted or unsubstituted alkyl group or a substituted or unsubstituted phenyl group; $R_{22}$ represents a hydrogen atom, a halogen atom, a 5-membered hetero ring system or a substituted or unsubstituted phenoxy group; $R_{23}$ represents a halogen atom, a carbonyl group, a carboxyl group, an acylamino group or a sulfonamino group; and m is 0 or an integer of 1 to 4.

$$Z_1-Q \qquad \text{(II')}$$

wherein $Z_1$ represents an aliphatic group or an aromatic group; Q represents a hydrogen atom, a substituted or unsubstituted alkyl group with 20 carbon atoms or less or a substituted or unsubstituted phenyl group with 20 carbon atoms or less.

4. A silver halide photographic material as claimed in claim 3, wherein the melting-point-lowering agent is represented either the following formula:

$$Z_3-L-Q$$

wherein $Z_3$ represents a substituted or unsubstituted alkyl group with 8–70 carbon atoms, or a substituted phenyl group with 8–70 carbon atoms; L represents a divalent linking group; and Q represents as defined in claim 4.

5. A silver halide photographic material as claimed in claim 4, wherein $Z_3$—L— of the melting-point-lowering agent represents an alkyl-substituted phenoxyalkanamido group.

6. A silver halide photographic material as claimed in claim 1, wherein the hydrazine derivative is represented by the following general formula (III):

$$R_{31}-\underset{\underset{A_{31}}{|}}{N}-\underset{\underset{A_{32}}{|}}{N}-G_1-R_{32}$$

wherein $R_{31}$ represents an aliphatic group or an aromatic group; $R_{32}$ represents a hydrogen atom, an alkyl group, an aryl group, an alkoxy group, an aryloxy group, an amino group, a hydrazino group, a carbamoyl group or an oxycarbonyl group; $G_1$ represents a carbonyl group, a sulfonyl group, asulfoxy group, $$-\overset{\overset{O}{\|}}{\underset{\underset{R_{32}}{|}}{P}}-$$

group, $$-\underset{\underset{O}{\|}}{C}-\underset{\underset{O}{\|}}{C}-$$

group, a thiocarbonyl group or an iminomethylene group; and $A_{31}$ and $A_{32}$ both represent hydrogen atoms or one represents a hydrogen atom and the other a substituted or unsubstituted alkylsulfonyl group, a substituted or unsubstituted arylsufonyl group or a substituted or unsubstituted acyl group.

* * * * *